US007418755B2

(12) United States Patent
Bledsoe et al.

(10) Patent No.: US 7,418,755 B2
(45) Date of Patent: Sep. 2, 2008

(54) WALKING BOOT FOR DIABETIC AND OTHER PATIENTS

(75) Inventors: Gary R. Bledsoe, Mansfield, TX (US); Brett O. Bledsoe, Cedar Hill, TX (US)

(73) Assignee: Medical Technology, Inc., Grand Prairie, TX (US)

( * ) Notice: Subject to any disclaimer, the term of this patent is extended or adjusted under 35 U.S.C. 154(b) by 622 days.

(21) Appl. No.: 11/065,418

(22) Filed: Feb. 24, 2005

(65) Prior Publication Data

US 2005/0172517 A1 Aug. 11, 2005

Related U.S. Application Data

(63) Continuation-in-part of application No. 10/396,031, filed on Mar. 25, 2003, now abandoned, which is a continuation of application No. 09/745,313, filed on Dec. 21, 2000, now abandoned.

(51) Int. Cl.
*A43D 9/00* (2006.01)

(52) U.S. Cl. ..... 12/142 N; 12/146 M; 36/110

(58) Field of Classification Search ..... 12/142 N, 12/146 M; 36/110, 88, 140, 154
See application file for complete search history.

(56) References Cited

U.S. PATENT DOCUMENTS 2,917,757 A * 12/1959 Scholl ..... 12/146 M
4,124,946 A * 11/1978 Tomlin ..... 36/43
4,399,620 A * 8/1983 Funck ..... 36/30 R
4,478,214 A 10/1984 Lamont
4,503,576 A * 3/1985 Brown ..... 12/146 M
4,914,837 A * 4/1990 Rieffel ..... 36/88
5,025,573 A * 6/1991 Giese et al. ..... 36/30 R (Continued)

OTHER PUBLICATIONS

Bledsoe Conformer Diabetic Boot Application Instructions, Rev. H, Apr. 2004.

(Continued)

*Primary Examiner*—Marie Patterson
(74) *Attorney, Agent, or Firm*—James E. Walton

(57) ABSTRACT

An orthopedic walking boot promotes rapid healing of diabetic foot ulcerations by lowering the maximum peak pressure imposed upon the foot. The walker has a hard unyielding shell which is designed for walking. The shell closely and rigidly supports a mid-sole in a foot-shaped bed. The mid-sole has a foot-shaped cavity with rounded sides adapted to form resilient support for the heel, arch and sides of a foot in addition to the bottom of a foot. A conformable inner-sole is adapted to fit over the foot-shaped cavity in the mid-sole and be compressed in response to foot pressure between the sides and bottom of the foot and the sides and bottom of the foot-shaped cavity in the mid-sole thereby compensating for small differences between the shape of the foot and the shape of the cavity. Weight applied to the foot is transferred to the walking shell by contact between the sides of the foot, arch, and heel and the arch, heel and sides of the foot-shaped cavity as well as the bottom of the cavity thereby decreasing the peak or maximum unit pressure on the plantar surface of the foot. A breathable bootie which wraps the foot and lower leg in a protective "cocoon" is preferably secured to the upper surface of the insole thereby preventing foreign materials from entering the foot cavity.

8 Claims, 16 Drawing Sheets

U.S. PATENT DOCUMENTS 5,078,128 A * 1/1992 Grim et al. ..... 602/23
5,329,705 A * 7/1994 Grim et al. ..... 36/88
5,370,133 A 12/1994 Darby et al.
5,452,527 A * 9/1995 Gaylord, Jr. ..... 36/110
5,464,385 A * 11/1995 Grim ..... 602/27
5,555,584 A * 9/1996 Moore et al. ..... 12/142 N
5,733,647 A * 3/1998 Moore et al. ..... 428/304.4
5,761,834 A * 6/1998 Grim et al. ..... 36/88
5,958,546 A * 9/1999 Mardix et al. ..... 428/71
6,228,044 B1 5/2001 Jensen et al.
2003/0196352 A1 * 10/2003 Bledsoe et al. ..... 36/110

OTHER PUBLICATIONS

Pollo, Fabian E., et al., Plantar Pressures in Fiberglass Total Contact Casts vs. a New Diabetic Walking Boot, Foot & Ankle International, Jan. 2003, vol. 24, No. 1, American Orthopaedic Foot & Ankle Society, Inc.

Crenshaw, Stephanie J. et al., The Effect of Ankle Position on Plantar Pressure in a Short Leg Walking Boot, Foot & Ankle International, Feb. 2004, vol. 25, No. 2, American Orthopaedic Foot & Ankle Society, Inc.

* cited by examiner

Shoe

Peak Pressure Measurements

Total Contact Cast

Peak Pressure Measurements

Diabetic Boot

Peak Pressure Measurements

WALKING BOOT FOR DIABETIC AND OTHER PATIENTS

CROSS REFERENCE TO RELATED APPLICATIONS

This application is a continuation-in-part of prior application Ser. No. 10/396,031, filed Mar. 25, 2003, now abandoned which was a continuation of prior application Ser. No. 09/745,313 filed Dec. 21, 2000, now abandoned, both of which are entitled "Walking Boot for Diabetic and Other Patients."

BACKGROUND OF THE INVENTION

1. Field of the Invention

The present invention relates generally to orthopedic devices, and more particularly to an orthotic support for assisting in the stabilization and proper healing of ulcerative or pre-ulcerative conditions, plantar fasciitis or other conditions of the foot, especially for diabetic patients.

2. Background of the Invention

The present invention relates to orthotic or orthopedic devices that are used to immobilize, support and brace the foot and ankle. The sole or plantar surface of the foot is often subject to conditions or injuries, such as stone bruises, heel spurs, soft tissue injuries or injuries of the muscles, ligaments, bones or joints. Foot problems of this kind are often painful and exacerbated by the patient's need to walk during the healing process. The degree of immobilization and protection required varies with the severity and difficulty of the condition. Relief may sometimes be obtained by use of a molded inner sole or orthotic pieces in a regular shoe to add stiffness or alter the pressure distribution on the foot. Another option is custom made shoes which, although expensive, may provide relief for minor conditions. These may be augmented with the use of ankle braces or crutches but provide little relief for more serious conditions.

Diabetics are subject to especially severe and difficult foot problems. As the condition of diabetes gets worse, these patients begin to develop a problem called neuropathy, or polyneuropathy where they lose the sense of feeling in the plantar surface or bottom of the foot which may extend from the toes up the foot to the heel and eventually up to the lower leg or higher. Because there is no feeling, these patients are subject to severe pressure induced ulcerations that can be caused by high peak pressures or by hard foreign particles that may get in their shoe and which they do not realize are present. This often results in ulceration of delicate skin, which in diabetic patients is often very difficult to heal. Sometimes the festering ulcerations become infected, contain scar tissue and may result in secondary problems up to and including amputation. There were an estimated 54,000 amputations of this kind done in the United States in 1998. There are an estimated 23 million diabetics in the United States alone.

Prior art solutions have attempted to solve the problem by attempting to control the pressure on the bottom or sole of the foot. For example, a company called Royce Medical Company has modified their ordinary leg walker by replacing the normal Poron™ inner sole with about a ⅜ inch thick cross linked polyethylene foam inner sole material known as "plastazote" where the upper surface is cut into small hexagon shapes of roughly ⅜ inch across. One or more of the hexagonal areas directly under the ulceration or pressure site can be removed to create a reduction in pressure at the ulcer site itself. This can sometimes cause a distended wound because the exudate coming out of the ulcerated area causes a distention of the ulcer site which eventually granulates in to form scar tissue that has to be shaved off to avoid high pressure in that area when the foot is placed in a normal shoe. Removal of support under part of the sole of the foot tends to increase pressure loading of remaining portions of the foot which are supported. It also may cause increased pressure in the ring surrounding the cut away portion, which may restrict blood flow to the wound. Royce Medical Company is the owner of U.S. Pat. No. 5,464,385 entitled "Walker with Open Heel".

Another example of the prior art approach is the walker produced by a company called Aircast, known as the Aircast Diabetic Walker™. To the ordinary walker they install a layer of about ½ inch to ⅝ inch thick cross-linked polyethylene foam referred to in the industry as "plastazote" foam in the bottom of the walker. It is a flat material which takes a compression set. While this does tend to distribute pressure over more of the foot to some extent, the support is still provided mainly by the boney prominences of the foot where the heel and ball of the foot fully compress the foam material. High unit pressure is found in those areas. We describe this result as producing a parabolic pressure distribution curve with a very high peak right under the boney areas.

Heretofore, the best available orthotic is a molded orthotic device which has been developed in the last several years using a technique called Total Contact Casting. Typically, a dressing is applied over the wound and then a piece of cotton or wool felt that will absorb exuding fluid is placed around the foot and held in place by a circularly knitted tubular material which is called a stockinet. Then, in one preferred method, a material called "conform"™ foam or "tempur"™ foam is used next. Approximately a ½ inch layer of this is placed under the arch and folded over the front of the toe down to the sides and pinched in on the sides creating somewhat of a cocoon below the ankle bones from the bottom of the foot up and over the forefoot. Over the top of this is wrapped some padding material for the cast which is either a cotton or polyester wool as is used for any other type of cast. Then a first layer of plaster or synthetic material is placed over the foot to form the cast and a wooden board is placed under the foot. Another layer of plaster or synthetic casting is plastered over the whole thing thus creating a "cocoon" for the foot. The "conform"™ foam or "tempur"™ foam has an open granular structure which compresses easily and rebounds extremely slowly. It will not sustain the body's weight without going to essentially zero thickness. We believe the Total Contact Cast nevertheless still produces a parabolic pressure distribution curve under the boney portions of the foot. Unfortunately, the total contact cast is heavy and not well designed for walking. The user has to pick the whole foot up and lay it down again, and it can only be used for about a week before it has to be removed and the foot cleaned and a new cast applied. The weight and bulkiness of the total contact cast create additional problems for diabetic patients. Patients can't remain immobilized to keep their weight off the cast. It is necessary for them to do some walking. Walking is beneficial because it actually stimulates the healing process. As a result, diabetics will start developing problems in other areas of their body because they are sensitive to pressure. Their tissues will break down at about half of what a young athlete can take without damage. The use of crutches can cause additional ulcers under the arms or on the hands.

Modern medical theories suggest that there may be some maximum threshold unit pressure if healing is to occur. If higher pressures are produced in "hot" spots, healing may take an extended time or be difficult to obtain at all. It appears that what might be called the time-pressure integral may also play an important role. The time-pressure integral relates to the cumulative effect of activity by the patient which produces pressures under all of the foot over a given time period.

Current theories suggest that ulcers will form in diabetic patients when peak unit pressure reaches 50 newtons per square centimeter (n/cm$^2$). For comparison, simply walking in ordinary shoes that have a contoured inner sole matching the shape of the foot can generate unit pressures around 50-60 n/cm$^2$. Running or suddenly changing direction will result in even higher unit pressures. Even diabetic shoes that contain a custom inner sole that is formed to match the patient's feet exactly are likely to generate unit pressures of 40-50 n/cm$^2$, which can still allow ulcers to form.

In additional to being significantly more susceptible to ulceration, a diabetic patient will also generally take a significantly longer period for such ulceration to heal. It is not uncommon for it to take 10-12 weeks for an ulcer on the foot of a diabetic patient to heal when using Total Contact Casting. In comparison, such an ulcer would likely heal in less than seven days in a healthy individual. While maintaining unit pressures below 50 n/cm$^2$ can minimize the formation of new ulcerations on the diabetic patient's foot, much lower unit pressures are necessary in order for the ulcer to heal properly and in a reasonable amount of time. Even below 50 n/cm$^2$ sufficient damage is still being done to a diabetic individual's skin to delay or even completely prevent the ulcer from completely healing.

The requirements for shoe insoles are not well geared toward producing an insole that significantly minimizes the maximum and average unit pressure applied to the bottom of the foot. The purpose of a shoe insole is to provide the necessary support for the various flexion positions of the foot. Forces in the foot change dramatically during the various phases of a person's gait. For example, at heel strike an entire individual's weight is being applied at the heel of the foot. At this stage the purpose of the inner sole is to cup the heel. At mid-stance, the individual's weight is spread out more evenly across the foot and the inner sole must provide adequate support to the arch of the foot. During toe-off, the individual's weight is concentrated at the balls of the feet and the insole must be able to flex and stabilize the foot. The necessary type of support that must be provided by the inner sole of a shoe especially during heel strike and toe off is the lateral support of the foot to prevent it from over rotating.

A shoe insole must also be able to withstand the large forces that are applied to portions of the inner sole at various phases of a person's gait without breaking down or becoming permanently compressed. An inner sole of a shoe accommodates the relatively large forces that are applied to the heel and the ball of the foot during certain phases of the gait by increasing the amount cushioning at those locations. This does attempt to minimize to some extent the magnitude of the peak forces that are applied to the foot, but does nothing to spread out the force over the entire surface of the foot. As a result, inner soles of shoes result in a significant parabolic force distribution curve, where peak pressures are significantly higher under the bony portions of the foot, even those that are contoured and that have upper layers designed to cushion the foot.

In order to achieve these purposes, the inner soles of shoes use relatively hard and dense materials to provide sufficient support over time, even for the relatively "soft" upper layers that are designed to cushion the foot. If the inner sole were made of a material that is too soft, the inner sole would flatten over a relatively short period of time due to the large peak pressures that occur at various portions of the gait cycle and would quickly lose the ability to provide any support or cushioning.

In addition to the increased likelihood of ulceration, a certain percentage of diabetic patients will also develop what is referred to as charcot condition. This is a hyper-circulation condition where the bones become very fragile. The bones go through a cycle of fracturing and healing that results in the loss of neural control and ultimately the bone degrades and crumbles. In the foot, the balls and heal of the foot degrade such that the fascia over the mid-sole will stick out below the heal and ball, sometimes referred to as rockerbottom charcot. Also, the cycling can cause calcification on the bone. This can result in a growth on the bony protrusion on the inside of the foot by the arch, giving the side of the foot somewhat of a "V" shape. Special consideration must be taken into account when designing a walking boot for diabetics that have charcot condition, such that the inner sole accommodates the differing contours of the foot and does not result in the creation of point pressures. This is generally accomplished by cutting away some of the foam insole in order to accommodate the deformity in the foot.

It would be desirable to have a walking boot which can be used over an extended period of time and which improves upon the attributes of the total contact cast by reducing the peak plantar pressure operating on the injured foot while walking in the walker. We have demonstrated such an improvement with a new approach that utilizes the arch and side areas of the periphery of the foot to support part of the load on the foot and reduce the maximum peak pressure under the sole of the foot.

SUMMARY OF THE INVENTION

The improved walking boot of the invention for diabetic and other patients reduces the maximum peak pressure applied to the bottom or plantar surface of the foot while standing or walking, as compared to the best prior art orthopedic devices. The new walking boot is referred to as the Bledsoe Conformer Boot. The walking boot has a premolded foot-shaped cavity and an inner-sole made of conformable material which is molded by foot pressure to the shape of the foot. It operates on the principle of preloading the arch and side edges of the foot to take and spread some of the weight load on the foot before the bottom of the foot is fully loaded. Supporting pressure for the foot is spread over a larger area to reduce the peak unit pressure at any particular area. This is an improvement over flat-bed boots even though they may have a contoured surface and be made of a flexible or spongy material and have a compressible insole.

Preferably, the improved walking boot has a walking shell having an inner surface with an upturned edge portion which forms an unyielding generally foot-shaped bed adapted to support a mid-sole. The walking shell has an upwardly angled forward portion which the tread follows to allow the boot to roll forward in a walking step. The rear portion of the heel on the tread is angled to improve walkability also. A mid-sole is supported and held in the generally foot-shaped bed of the walking shell. The mid-sole is premolded to form a foot-shaped cavity with upwardly and outwardly rounded side edges to form a resilient but non-compressively setting support for the arch and sides of the heel and foot in addition to the bottom of the foot. The mid-sole can be a single density layer or it may be a dual density layer with a denser bottom layer to provide the non-compressively setting support and an upper layer that is less dense and somewhat compressive, thereby allowing the boot to accommodate a wider range of foot shapes, including those deformities formed by charcot condition. Over the foot-shaped cavity of the mid-sole is placed a conformable inner-sole formed from a pliable but compressibly settable material which is referred to as a self-molding material that takes the shape of the bottom portion of the loaded foot when the foot is pressed into the foot-shaped cavity. In response to foot pressure between the sides, arch, and bottom of the foot and the sides, arch, and the bottom of the foot-shaped cavity in the mid-sole, the inner-sole conforms to the shape of the foot thereby compensating for small differences between the shape of the foot and the shape of the foot-shaped cavity. Weight applied to the foot compresses and molds the conformable inner-sole to fit tightly between the heel, arch, and sides of the foot and the sides and arch area of the cavity thereby preloading the foot along the heel, arch, and sides of the foot before the heel and ball of the foot are fully loaded by compressing the inner-sole and the mid-sole at the bottom of the cavity. The foot-shaped cavity in the mid-sole has a foot-shaped opening near the size of a selected average foot. The size and shape of the foot-shaped cavity and the thickness of the conformable inner-sole are selected to assure that the foot is preloaded along the sides and arch of the foot-shaped cavity before the foot is fully loaded on the bottom of its heel and ball areas. This is accomplished by having the foot shaped cavity be deeper than the depth of the foot and slightly narrower, so that the perimeter of the foot is loaded prior to the loading of the bottom of the foot. The cross sectional thickness of the mid-sole at the highly loaded areas under the heel and ball of the foot are selected to be a minimum thickness in order to minimize leg height differential and any relative motion tending to be caused by compression of the mid-sole arising because of periodic compression of the mid-sole in response to foot loading while walking. Relative motion between the foot and the foot-shaped cavity is minimized to prevent any tendency for chafing.

The walking shell preferably has upwardly turned edges along the sides and heel areas which provide support to the outer lower surface of the mid-sole to prevent any spreading of the mid-sole in response to pressure from the weight of the patient. The upper surface of the foot-bed and the lower outer surface of the mid-sole are closely conforming so that unyielding support is provided by the rigid walking shell.

The walking shell preferably has a pair of upstanding struts, which extend upwards on both sides of the leg, attached to the upturned edges of the shell which serve to secure the walking boot on the leg of the wearer. The walking boot further includes a durable and resilient soft protective bootie adapted for extending around the lower leg and foot and having an open bottom portion having sides all around the foot and a toe box that are secured to the upper surface of the inner-sole to form a soft protective bootie around the foot and lower leg. Attached to each of the struts is a sheath which is provided with patches of hook and loop material for the purpose of attaching the bootie to the shell. The bootie also has appropriately located patches of hook and loop material which together with encircling straps removably secure the structure to the leg. The shell also contains straps together with hook and loop material or other appropriate fastening means which hold the assembly snugly on the foot.

The Bledsoe Conformer Boot is usable for the duration of the injury and does not have to be replaced every five to seven days as does the Total Contact Cast. The conformable inner-sole comprises an elastomeric foam having a skinned outer surface to prevent penetration by moisture, exudate or other liquids to which it might be exposed. Since these materials do not penetrate the inner-sole, the material is subject to washing and/or disinfecting if it is necessary to dress a wound or ulcerated area. Unlike the Total Contact Cast, which is fixed on the lower leg and foot, the Bledsoe Conformer Boot is removable by the patient, as for example, at bed time. It is truly a walker that facilitates walking because it has good walkability due to the shape of the floor contacting surfaces. The bootie is made from a soft breathable foam material of about ¾ inch in thickness which together with the insole provides a protective "cocoon" to prevent foreign materials from entering the foot chamber.

DETAILED DESCRIPTION OF THE PREFERRED EMBODIMENT

Figure 1:
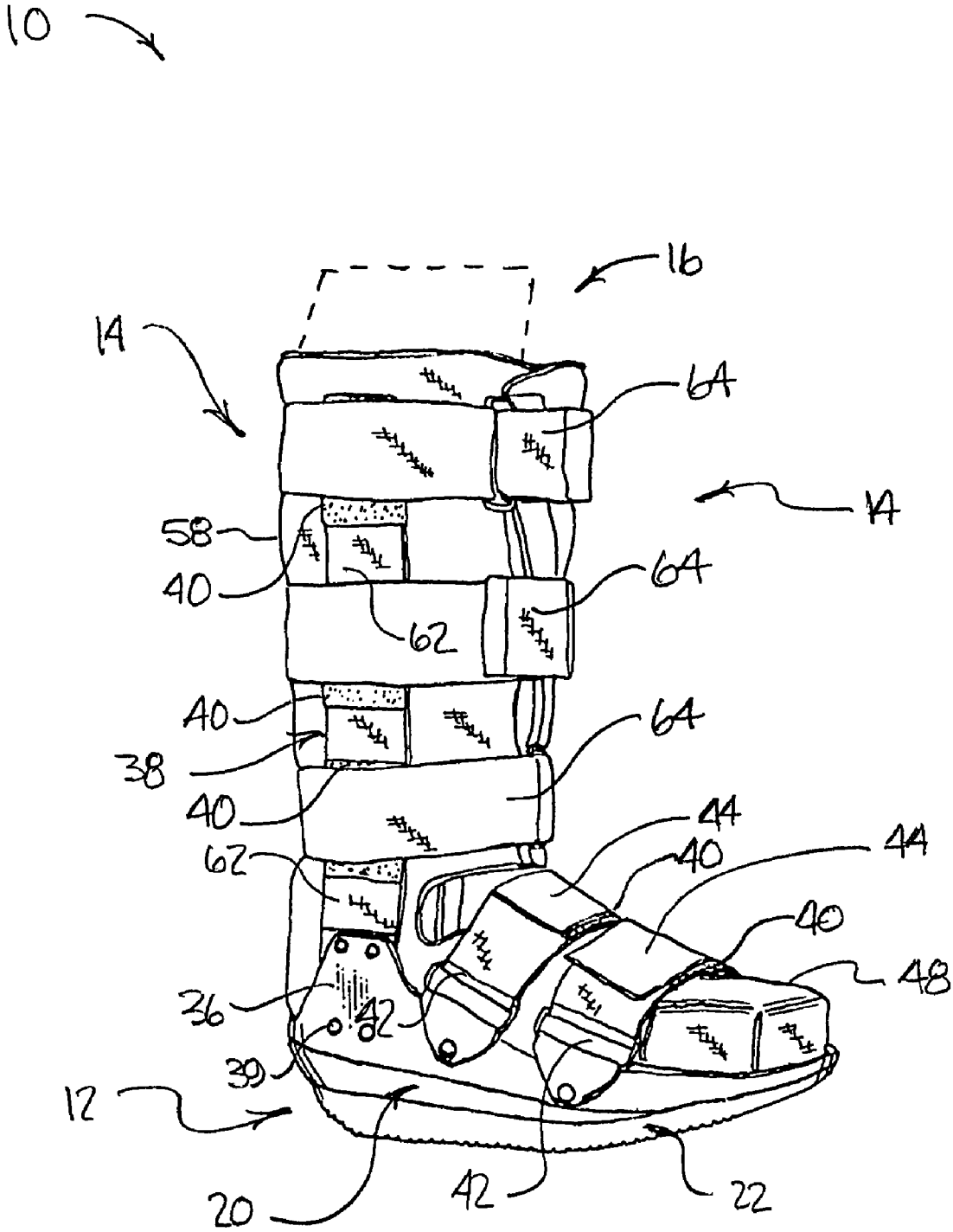
FIG. 1 is a perspective view of the improved walking boot and bootie in the completely installed position.

In the description that follows, the improved walking boot for diabetic and other patients of the invention, is designated generally by the reference numeral 10. Throughout the description that follows, the same reference numerals will be applied to similar parts. Reference numerals with primes represent similar structure not exactly the same.

Figure 2:
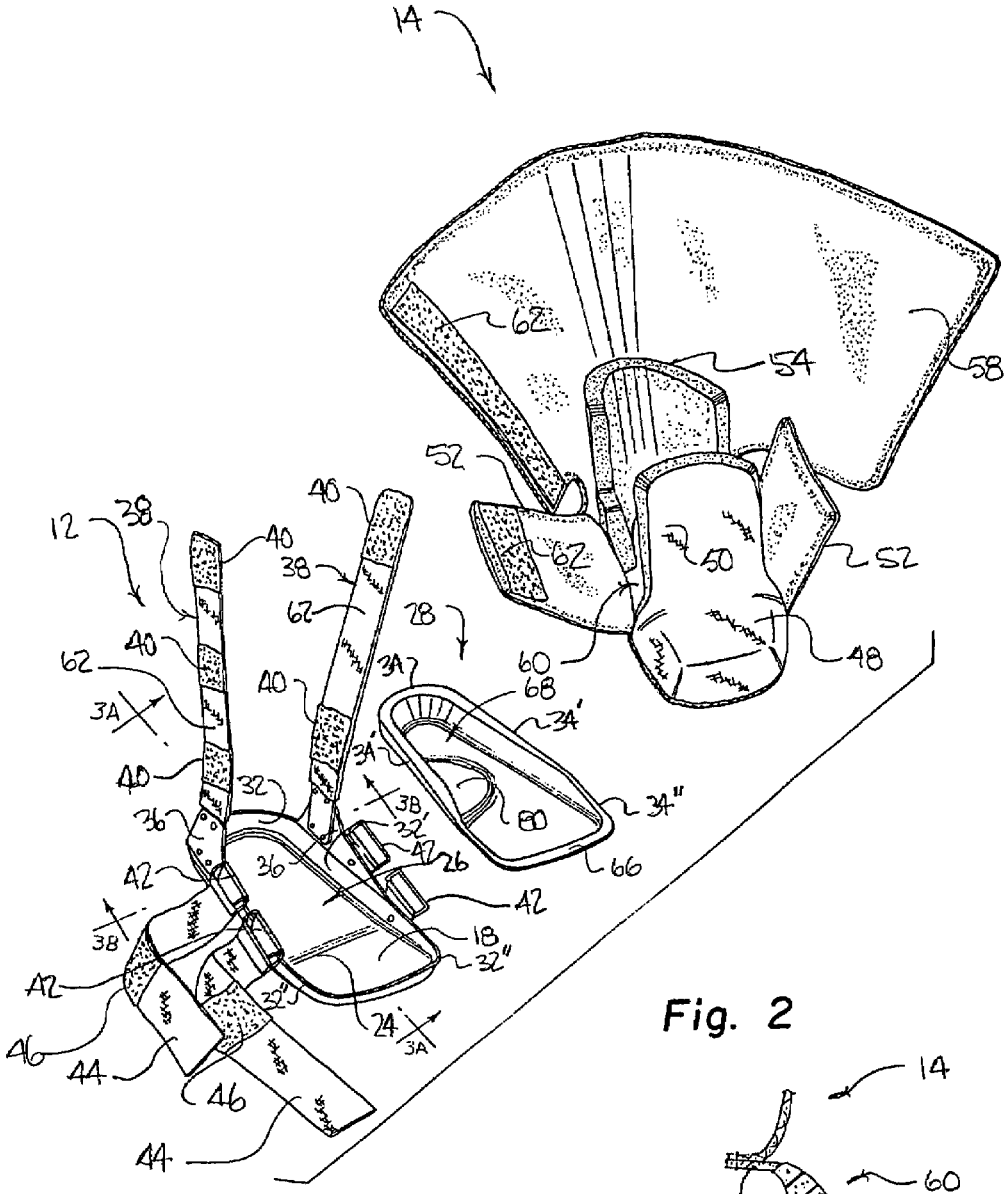
FIG. 2 is an exploded perspective view showing the walking shell, mid-sole and construction of the bootie secured to the inner-sole of the walker of FIG. 1.

FIGS. 1 and 2 illustrate the combination of a walking shell generally designated 12 and what is referred to as a protective "bootie" generally designated by the reference numeral 14. This is more clearly seen in FIG. 2 where they are separated. FIG. 1 illustrates a combination in use on a patient's leg and foot 16 which will be referred to as foot 16.

Walking shell 12 in FIGS. 1 and 2 has an inner surface 18 and an outer surface 20 to which is attached a walking tread 22 preferably made of elastomeric material such as rubber. The shell is preferably bent slightly upwardly at what will be called a "rocker" line 24 which improves walkability of the structure when the patient moves forward. The tread follows the shape of the shell in this regard. An angled heel on the tread and an angled front greatly improve walkability.

Inner surface 18 of the walking shell comprises a foot bed in the shell designed to receive and support a mid-sole 28 which is seen in more detail in FIGS. 4A-4F. The mid-sole has a lower outer surface 30 which is supported by the inner surface 18 of walking shell 12. Walking shell 12 has upwardly turned edges 32 in the heel area, edges 32' in the side foot area and 32" in the forefoot area. Although they need not be symmetrical, it is preferred that the upturned edges be generally the same on both sides. The lower outer surface of 30 of mid-sole 28 has upwardly rising side portions 34 at the heel, 34' at the sides of the foot and 34" in the forefoot area which correspond to the upwardly turned edges 32, 32' and 32" of the walker shell. These surfaces conform with each other to provide firm unmoving support for the mid-sole. Additionally, it may be desirable to secure by means of adhesive or tape with adhesive, the lower outer surface of the mid-sole 28 to the upper surface or surfaces of foot bed 26.

Figure 3B:
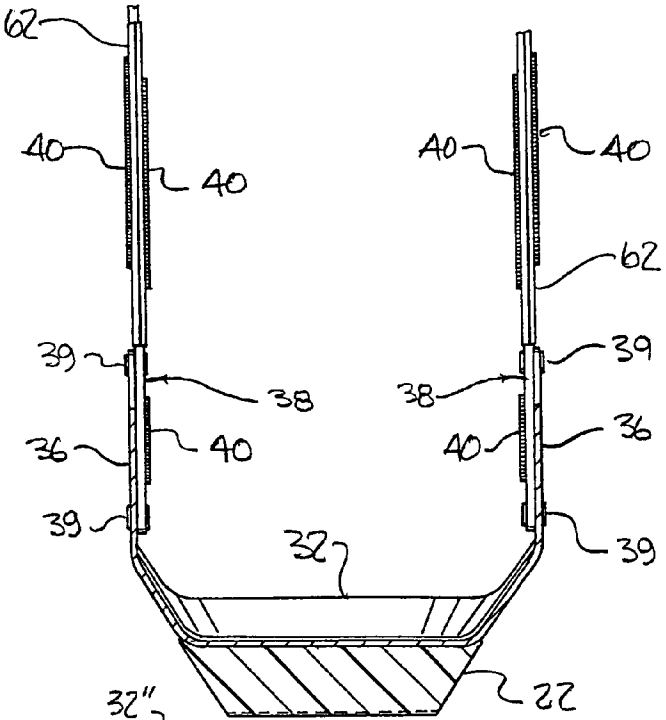
FIG. 3B is a sectional elevational view of the walker shell of FIG. 3A on the lines 3B-3B looking to the rear of the boot.
Figure 3A:
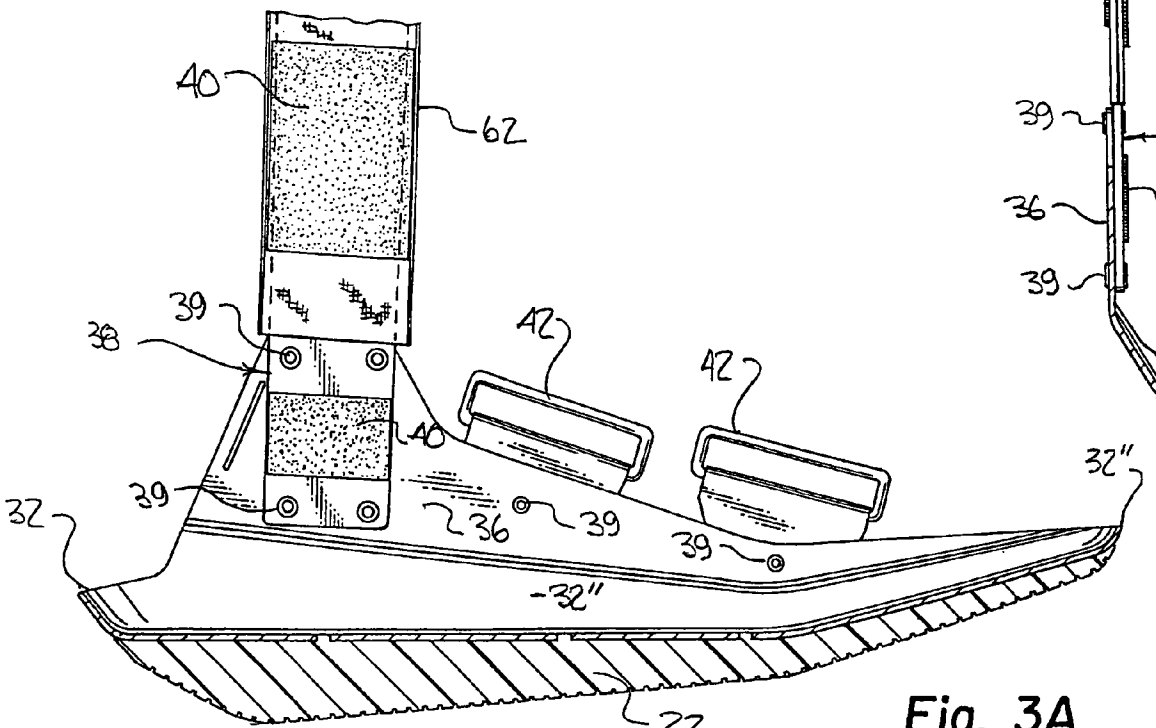
FIG. 3A is a sectioned side elevation of the walker shell on the lines 3A-3A of FIG. 2 showing one of the upwardly extending struts on the shell and fastening means which are used to secure the walker to the foot.

Walker shell 12 further includes a flange 36 which is preferably formed as an extension of the sides 32' on each side of the shell. Attached to each one of the flanges 36 is an upright strut 38 comprising a pair of upright struts 38. The upright struts 38 are attached to the flanges 36 by means of fasteners 39 best seen in FIGS. 3A and 3B. Each strut 38 is preferably covered with a cloth sheath 62 (attachment means) which is provided with spaced apart patches of hook and loop material 40 which are used to removably attach bootie 14 as seen in FIG. 1. Attachment straps 64 have hook and loop material on their underside to engage hook and loop material 40 on the sheath 62 covering the struts to encircle and secure the entire walking boot assembly to the lower leg and foot 16. The outer surface of second back portion 58 has patches of hook and loop material to engage corresponding patches of hook and loop material 40 on the inside of the sheaths 62 as well as seen in FIGS. 1 and 3B. These constitute means for removably attaching booties 14 containing the lower leg and foot to the walker shell 12. Buckles 42, preferably two on each side of the shell are fastened to the shell. Fastening means include a pair of straps 44 also having hook and loop material 46 at appropriate locations. These straps 44 strap over the bootie and foot to hold the walker shell and bootie 14 components in place.

Protective bootie 14 is best seen in FIGS. 1 and 2. Bootie 14 is made with soft flexible spongy foam material which preferably breathes to some extent when it is wrapped around and secured to cushion the patient's foot. Bootie 14 has a toe box 48, a tongue 50, side panels 52, a first back portion 54 and a second back portion 58. An inner-sole generally indicated by the reference numeral 60 is seen forming the bottom of bootie 14 on which the sole of the foot will rest. Appropriately placed hook and loop material 62 is fastened to the bootie at appropriate places which makes it possible to enclose the injured foot within the bootie as shown in FIG. 1. The foot is placed in bootie 14 and the open flaps 52 are crossed over the tongue 50 and fastened with hook and loop material 62. The second back portion is wrapped around the lower leg and heel and also fastened with hook and loop material 62. The foot and bootie are placed in the shell and the straps 44 are passed over the overlapping side portions and tongue of bootie 14 where they are secured by hook and loop material 46.

Figure 4A:
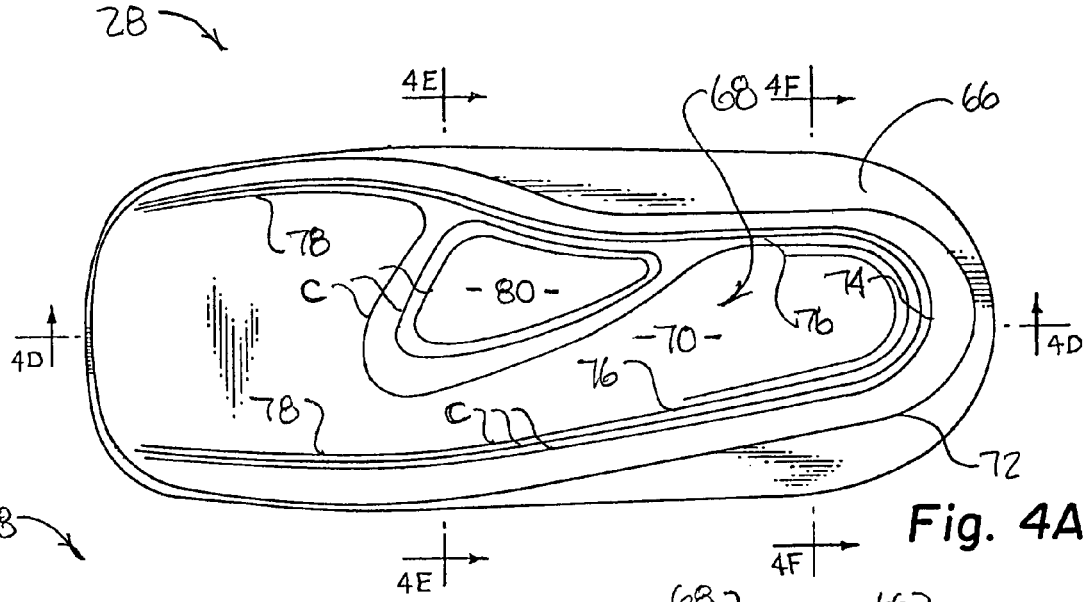
FIG. 4A is a plan view of the mid-sole which is supported directly on its bottom surface by the inner surface of the walker shell.

An improved supporting platform for the bottom of the feet is provided by the combination of a pre-molded mid-sole illustrate in FIGS. 4A-4F and a self-molding inner-sole illustrated in FIGS. 5A-5F. In FIGS. 4A-4F, mid-sole 28 is pre-molded to have a lower outer surface adapted to be received in the foot bed of the walker shell and an upper surface 66 raised above the lower surface 30 and having a foot shaped cavity generally designated 68. Foot-shaped cavity 68 has a bottom surface 70 spaced below upper surface 66. Mid-sole 28 is formed, preferably in one structure, from a material having the characteristic that it will rebound from pressure force imposed by a foot and will not take a compression set, thereby essentially retaining its pre-molded shape after use. Yet it is flexible and will yieldingly deform to a limited degree when loaded by a foot. Most significantly, the foot shaped cavity 68 has upwardly and preferably outwardly curving sides which rise to a foot shaped opening 72 at upper surface 66. Foot shaped cavity 68 has upwardly curving side walls 74 around the heel area, upwardly curving side walls 76 along the sides of the foot in the mid-foot area and upwardly curving side walls 78 in the forefoot area. The upwardly curving walls at any given elevation generally lie parallel the foot shaped opening 72. Also provided is an arch support area 80, which rises smoothly from the bottom in the normal manner of arch supports. The contour lines "C" in FIG. 4A are meant to indicate changes in elevation much as in a topographical map. It should be noted that this depressed area which comprises the foot shaped cavity 68 is fairly deep, especially at the heel area and in the vicinity of the front of the mid-foot where the ball of the foot will be placed. The depth may range from approximately ¾ inch to as much as approximately 1 inch in the deepest areas. The exact depth and size of the foot-shaped cavity is largely a matter requiring some experimentation to obtain the best results but should generally be slightly deeper than the depth of foot 16, such that sides of foot 16 begin to be loaded prior to the bottom of foot 16 reaching the bottom of foot shaped cavity 68. The foot shaped cavity 68 should be slightly narrower and deeper than foot 16, although it may be the same width or slightly larger than foot 16 due to the added thickness of inner-sole 60 that will be located between mid-sole 28 and foot 16.

With the foot shaped cavity 68 about the same or slightly larger than the outline of a foot, the unique pre-molded cavity provides peripheral side edge support for the foot during standing or walking which is superior to any form of flat bed or contoured flat surface and reduces "peak pressure" on any particular area of the bottom of the foot. Peak pressure is meant to indicate the maximum unit pressure applied to any given portion of the foot while walking in the boot structure. Part of the load is spread around the sides of the foot rather than just being supported on the bottom of the foot, as is the case when the foot is placed on a flat surface. When the foot is placed on a flat surface, peak pressures can be expected mainly under the heel and ball of the foot where forces from the foot bones are primarily applied and where there is a minimum of protection underneath the boney projections in those areas in the form of flesh, muscle and fatty tissue. The exact shape and curvature of the walls in the foot shaped cavity is largely a matter of trial and error and subject to the difficulty that feet do not come in a standard uniform shape or size. Nevertheless, the basic principle of providing a foot shaped cavity with sloping walls has been shown to reduce the maximum or peak unit pressure and the average unit pressure over the best alternative currently available, namely the Total Contact Cast.

In general, the foot shaped cavity has a shape such that the top of the curved sides contact the edges of the foot prior to the heel and ball of the foot contacting the bottom of the foot shaped cavity. This results in the edges of the foot starting to be loaded prior to the heel and the ball of the foot. The edges of the foot are preferably preloaded to an extent such that when the foot is fully loaded, the force is evenly applied across the entire bottom of the foot as well as along the edges. This significantly minimizes the peak pressure that normally appears under the ball and heel of the foot. Because there are differences in shape and size of feet, the mid-sole of the invention is preferably used in combination with an inner-sole 60 having generally a foot shaped outline but having quite different characteristics.

Figure 4B:
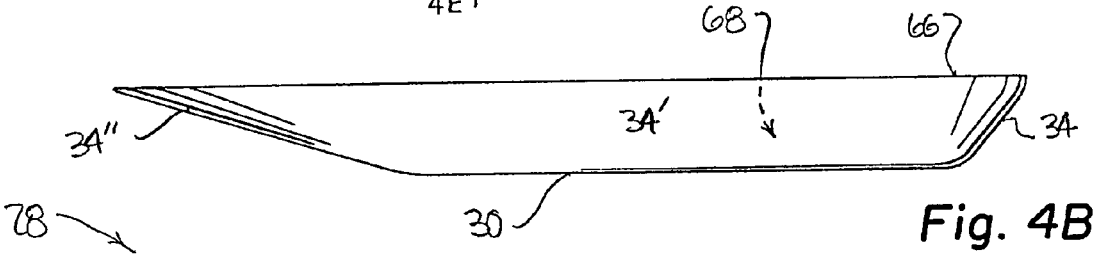
FIG. 4B is a side elevation of the mid-sole of FIG. 4A.
Figure 4C:
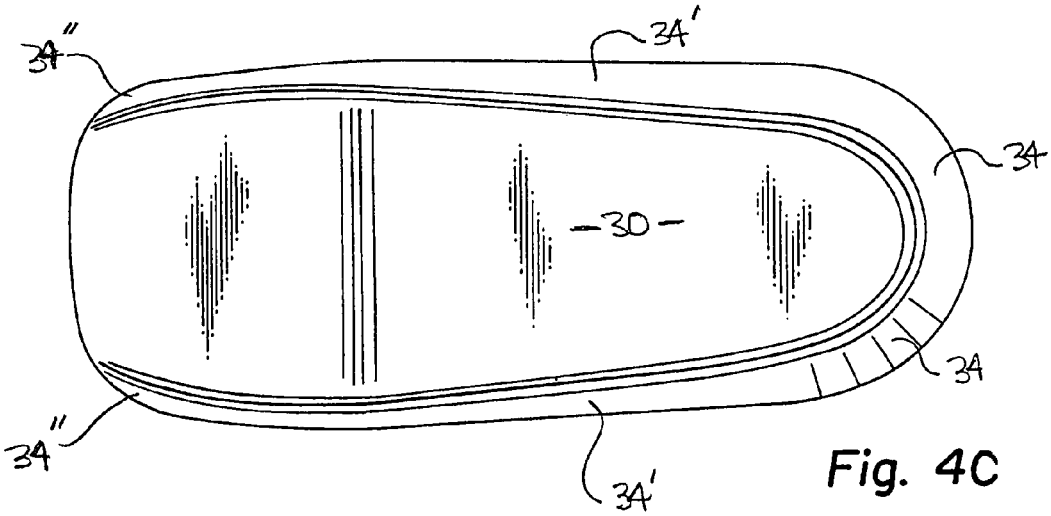
FIG. 4C is a bottom view of the mid-sole of FIGS. 4A and 4B.
Figure 4D:
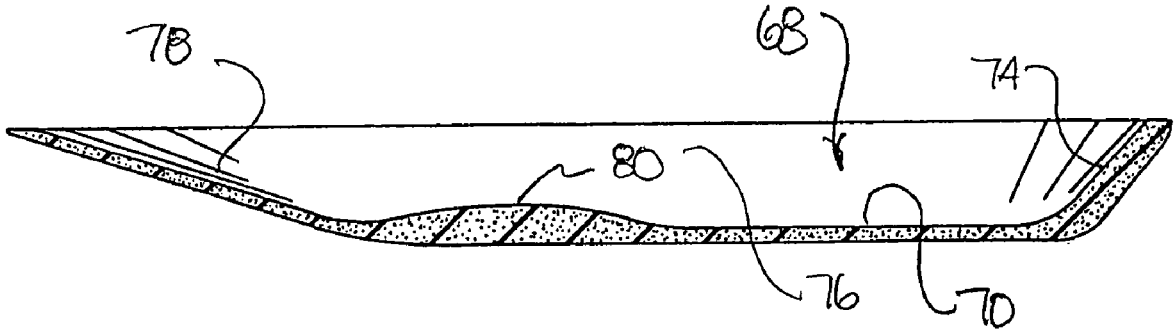
FIG. 4D is a section in side elevation of the mid-sole for the walker shell of FIG. 4A-C along the lines 4D-4D of FIG. 4A.
Figure 4E:
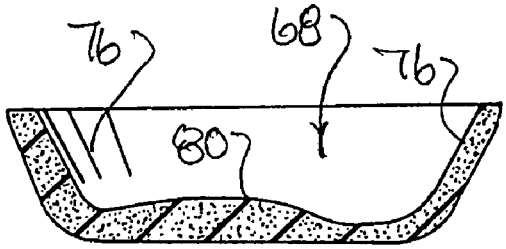
FIG. 4E is a section in front elevation at the arch area of the mid-sole of FIG. 4A-C on the along the lines 4E-4E of FIG. 4A.
Figure 4F:
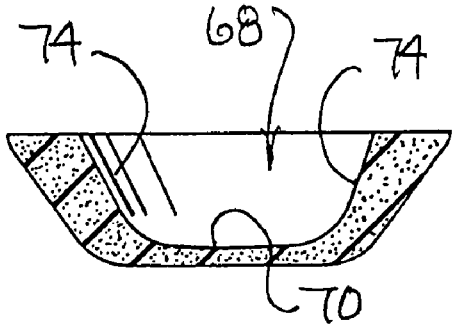
FIG. 4F is a section in elevation of the heel area of the mid-sole of FIG. 4A-C along the lines 4F-4F of FIG. 4A.
Figure 15A:
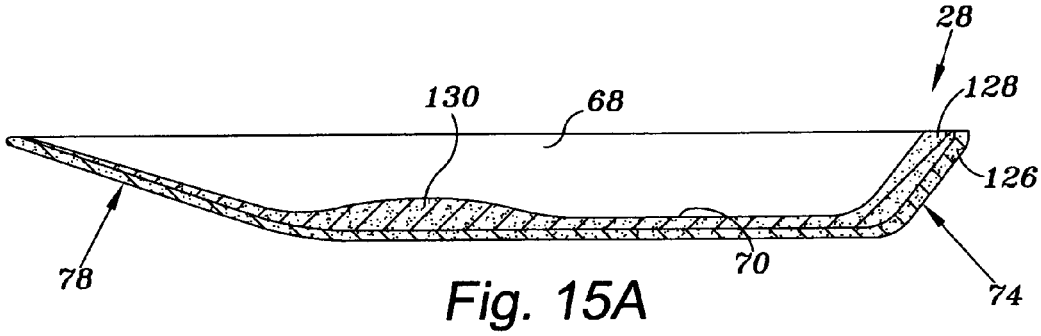
FIGS. 15A is a section in side elevation of the dual layer mid-sole for a second embodiment of the walker, also taken along the lines 4D-4D of FIG. 4A.
Figure 15B:
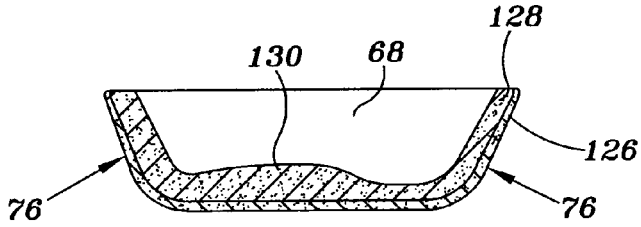
FIG. 15B is a section in front elevation at the arch area of the second embodiment of the walker, also taken along the line 4E-4E of FIG. 4A.
Figure 15C:
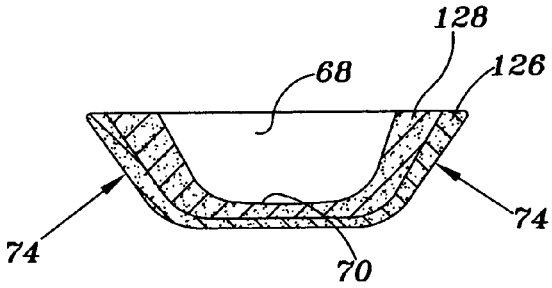
FIG. 15C is a section in elevation of the heel area of the second embodiment of the mid-sole, also taken along the lines 4F-4F of FIG. 4A.

In a second preferred embodiment, shown in FIGS. 15A to 15C, the improved walking boot 10 contains a mid-sole 28 that is composed of a lower density upper layer 128 and a higher density lower layer 126, but that is otherwise the same as mid-sole 28 depicted in FIGS. 4A-4C. While lower density upper layer 128 has some compressibility, it does not take a compression set like the inner-sole layer does. Higher density lower level 126 does not appreciably compress upon application of pressure from the foot and generally remain in its premolded shape after use. The combination of the higher density layer 126 and lower density layer 128 results in a mid-sole 28 that creates the same foot shaped cavity 68 as single density mid-sole 28 while accommodating varying shapes of foot 16, such as would occur if there was a deformity on foot 16.

This dual density mid-sole 28 acts as a shape change buffer while still providing the support necessary to pre-load the sides of the foot and keep the peak pressure at a minimum. The dual density mid-sole is especially important when treating an ulcer in a diabetic patient who has charcot condition, or other deformity of the foot. In previous walking boots, a portion of the sole generally by the arch of the foot would have to be cut away to prevent a pressure point from forming at the deformity on the foot. This adds a layer of complexity for the physician who is applying the brace, can create its own pressure points if not the material is not trimmed properly and smoothly, and must be modified over time to accommodate any further changes in the deformity. Changes in the deformity are especially likely to occur in a patient who has charcot condition.

Figure 16A:
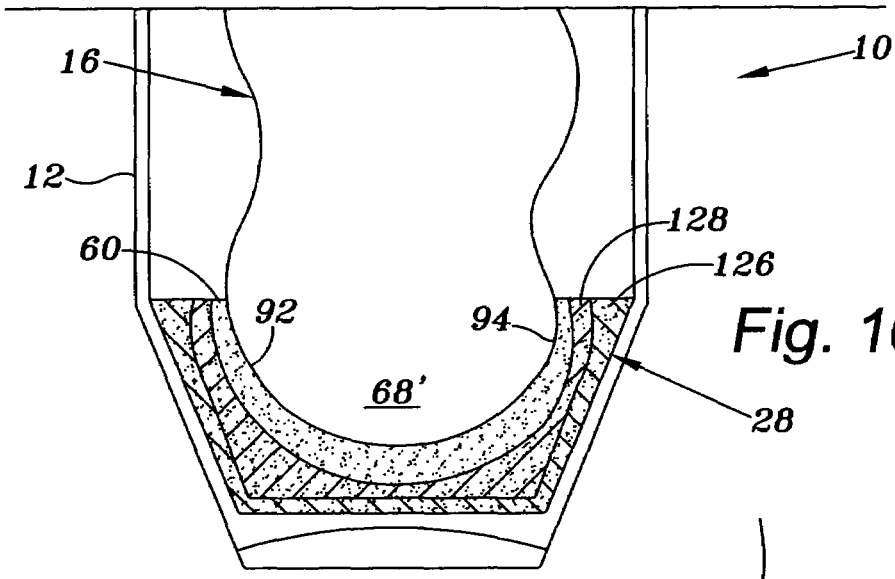
FIG. 16A is a cross section elevation in the heel area of the second embodiment of the improved walking boot of the present invention showing how part of the load is supported on the sides of the in-sole/mid-sole combination in addition to the support provided to the bottom of the foot.

In the second embodiment, as can be seen in FIG. 16A, upper lower density layer 128 of mid-sole 28 can compress to some extent, thereby accommodating differences in the shape of foot 16 or any deformity that may be present on foot 16, without the need to carve away a portion of the sole or creating points with higher than average peak pressures. This allows walking boot 10 to accommodate a larger range of variations in foot 16, including irregular deformities, than could be accommodated with single density mid-sole 28.

If necessary, walking boot 10 can be further modified by bending the aluminum shell to accommodate a larger deformity in the shape of the foot. Even higher density lower portion 126 of mid-sole 28 is still flexible enough that mid-sole 28 will be pressed against upward turned edges 32 of shell 12 and take on the configuration of the bent portion of upwardly turned edges 32. This allows walking boot 20 to accommodate the deformity in foot 16 while still providing the necessary support and preloading of the sides of foot 16 to minimize the peak pressure over the entire bottom of foot 16.

Figure 5A:
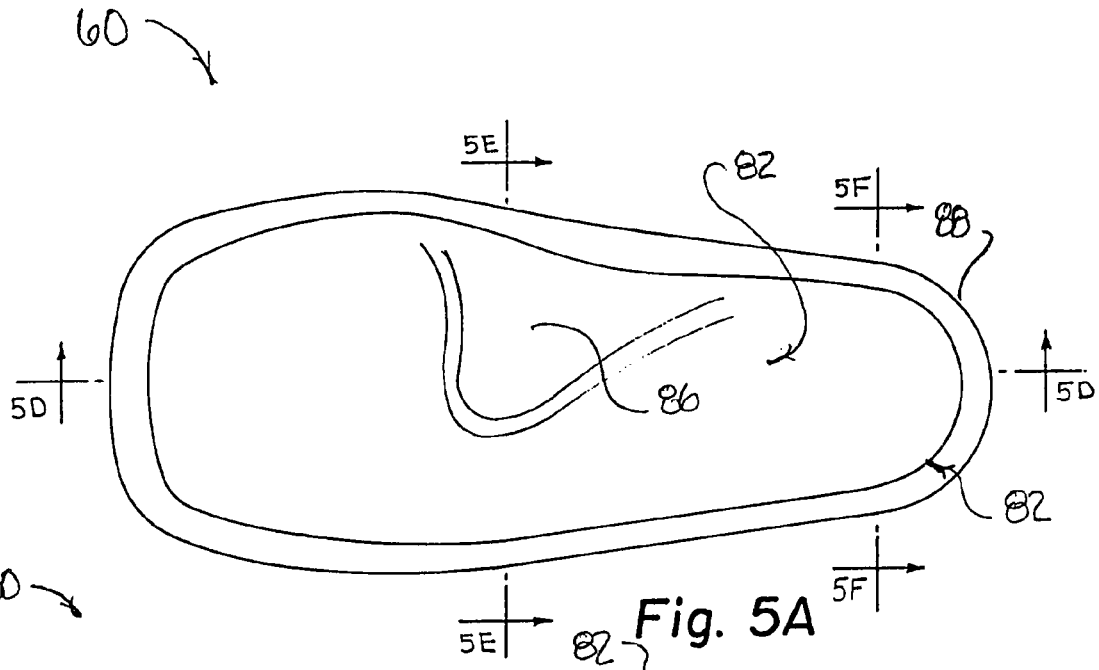
FIG. 5A is a plan view of the upper surface of the inner-sole which is supported by the mid-sole of FIGS. 4A-F.
Figure 5B:
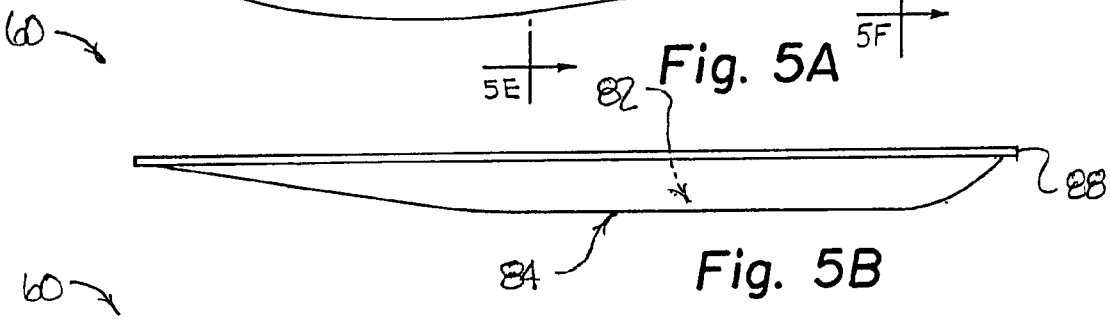
FIG. 5B is a side elevation of the inner-sole of FIG. 5A which shows a flange extending laterally from the upper surface.
Figure 5C:
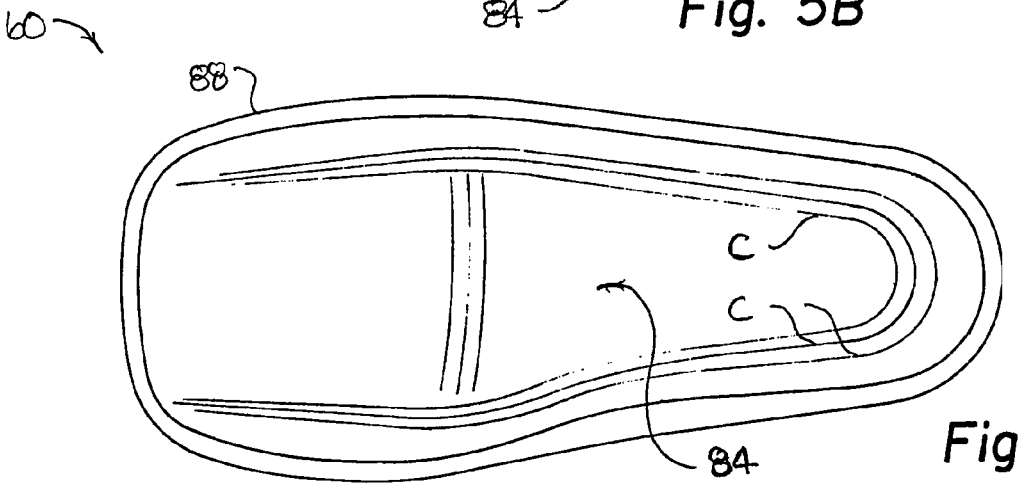
FIG. 5C is a bottom view of the inner-sole of FIGS. 5A and 5B.

Inner-sole 60 is illustrated in FIGS. 5A-5F. The combination of inner-sole 60 and mid-sole 28 is illustrated in FIGS. 6A and 6B. Referring now to FIGS. 5A-C, inner-sole 60 has a foot receiving upper surface 82 and a lower outer surface 84 comprising a bottom surface adapted to fit over upper surface 66 of mid-sole 28, especially over the foot-shaped cavity 68.

Figure 2A:
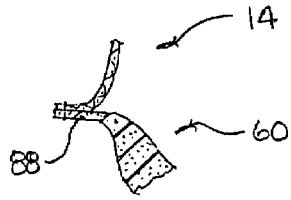
FIG. 2A illustrates a preferred manner in which the bottom edge of the bootie can be attached to the inner-sole.
Figure 5D:
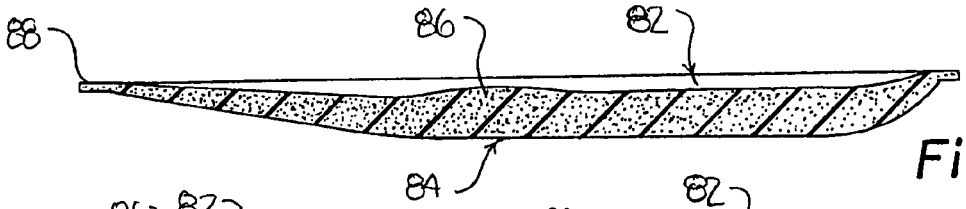
FIG. 5D is a section in side elevation of the inner-sole of FIG. 5A-C along the lines 5D-5D in FIG. 5A.
Figure 5E:
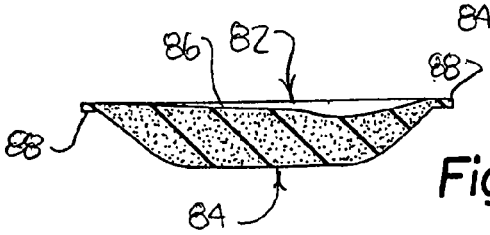
FIG. 5E is a section in front elevation at the arch area of the inner-sole of FIGS. 5A-C along the lines 5E-5E of FIG. 5A.
Figure 5F:
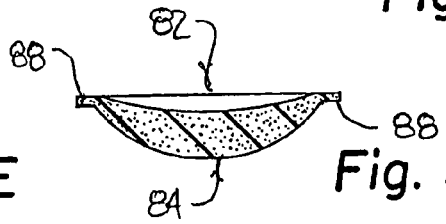
FIG. 5F is a section in front elevation of the heel area of the inner-sole of FIG. 5A-C along the lines 5F-5F of FIG. 5A.
Figure 6A:
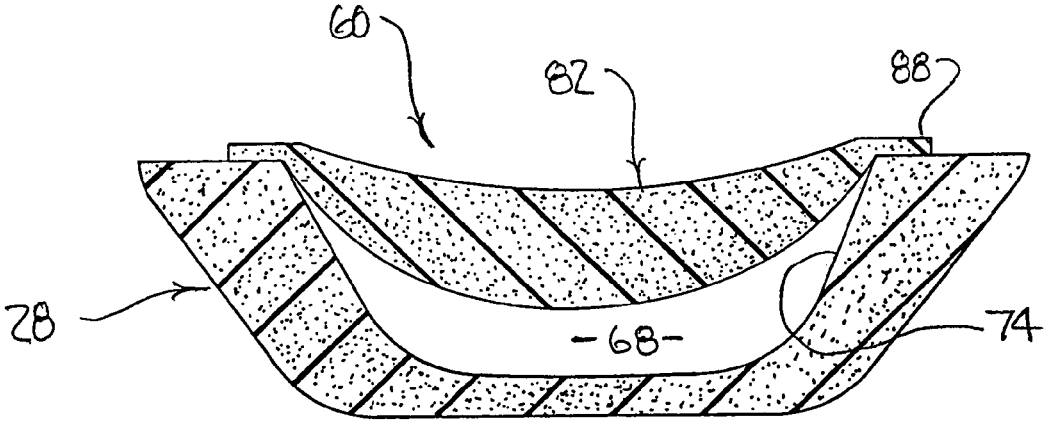
FIG. 6A is a cross sectional representation in elevation through the heel area of the combined in-sole/mid-sole showing the position of the mid-sole below and the in-sole above before the weight of a foot is imposed upon the in-sole.
Figure 6B:
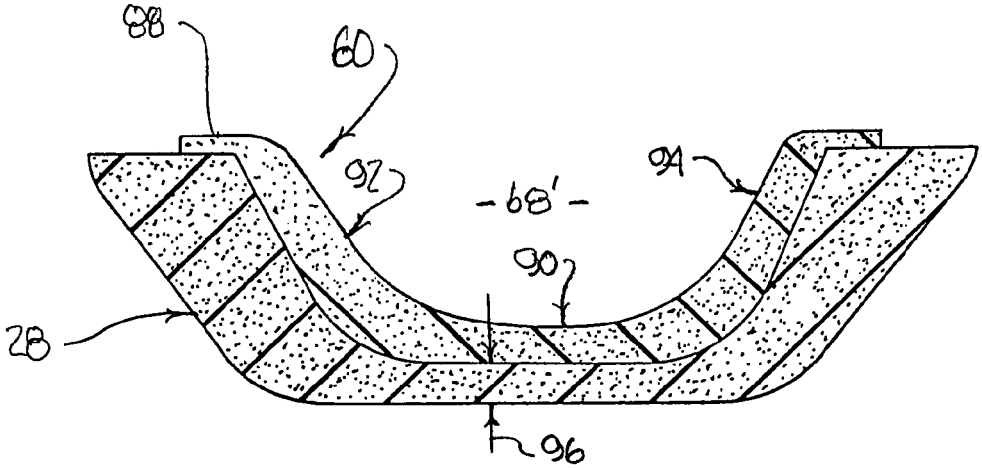
FIG. 6B is a combination mid-sole and in-sole of 6A after the weight of a patient's foot has been imposed upon the in-sole of FIG. 6A.

Upper surface 82 of inner-sole 60 preferably has a slightly depressed contoured upper surface as indicated in FIGS. 5D-5F. This is largely a matter of feel and comfort, which help center the foot. The bottom surface or underside 84 is also contoured as indicated by the contour lines C in FIG. 5C. A raised contoured arch area 86 may be included for comfort, better fit and arch support. A peripheral flange 88 is preferably provided all around inner-sole 60. Peripheral flange 88 is useful for securing inner-sole 60 against movement and provides a convenient means of attachment to bootie 14 as indicated in FIG. 2A by sewing, adhesive or other means.

Inner-sole 60 is preferably formed in one piece from a material having a self-molding characteristic in response to pressure from a foot. It is a spongy preferably foam material having the characteristic that it does not readily rebound from pressure force and will take a compression set in response to foot pressure. The material should compress readily for more than half of its thickness before it begins to significantly resist further compression caused by foot 16. Inner-sole 60 preferably is molded from an elastomeric foam material having a skinned outer surface to prevent absorbing fluids from ulcerated areas of a patient's foot. Because inner-sole 60 can be cleaned, it does not require discarding after a period of use by a patient as does the Total Contact Cast. If the bottom of foot 16 changes to some extent, such as would occur after debridement or if the type of dressing used is altered, a hair dryer or hot air blower can be used to partially rebound inner-sole 60. The partial rebound of inner-sole 60 is sufficient to accommodate minor changes to the shape of the foot, however, inner-sole 60 will not rebound to its original condition.

The combination of single density or dual density mid-sole 28 and the compression set inner-sole 60 results in foot shaped cavity 68' that is slightly narrower and deeper than foot 16 at the bottom, especially by the heel and ball of foot 16. Consequently, as the foot is placed on the inner-sole 60, the sides of foot 16 begin to compress mid-sole 28 along upwardly turned edges 74, 76, and 78 first. This results in the walking boot beginning to load the sides of foot 16 prior to the bottom. A significant amount of load is thereby removed from the foot before the heel and ball of foot 16 finally reach the bottom of foot shaped cavity 68' and become fully loaded. The resulting distribution of the load on foot 16 is significantly broader and more uniform, avoiding the parabolic force distribution that is present in custom molded shoes and even the total contact casting system.

FIGS. 6A and 6B illustrate how the mid-sole 28 and inner-sole 60 work together to distribute foot loading to the boot shell over a greater peripheral area of the foot. These are simplified diagrams that exclude all the other components of the walking boot of FIG. 1 for purposes of clarity. For purposes of illustration, these may be considered cross sections through the heel area of FIG. 4F and FIG. 5F, although the same advantage is observed around the rest of the foot.

FIG. 6A illustrates the initial condition before the materials have been subject to foot pressure. In FIG. 6B, inner-sole 60 has been self-molded by exposure to foot pressure and compressed to a significant degree, especially in the bottom area 90 of FIG. 6B. The sidewall areas 92, 94 have been compressed also, but to a lesser extent than the bottom 90, as compared to the original thickness of inner-sole 60. Although inner-sole 60 in its compressed configuration remains flexible and retains some compressibility, it is essentially compression set. It does not return to its original shape when the foot is removed whereas mid-sole material 28 always returns essentially to its initial shape when force imposed by the foot is removed. The result is an altered foot-shaped cavity 68' which has been self-molded by the foot to form upwardly and outwardly curving sidewalls 92, 94 around the heel and other sides of the foot. Pressure from the foot has caused the inner-sole to mold itself closely to the loaded shape of the foot and tightly against the upwardly and outwardly curving walls of mid-sole 28. It can be seen that the load imposed on the foot by the weight of the person is not concentrated only on bottom 90 but is also partially resisted by the side portions 92, 94 because the shape and thickness of the material is selected so that the outer peripheral edges of the foot come in contact with the side walls of the foot-shaped cavity 68' before the foot bottoms out at the bottom 90. It should also be noted that the cross sectional thickness 96 of mid-sole 28 is selected to be a lesser thickness under those parts of the foot having boney protuberances, here the heel, thereby minimizing leg height differential and any relative motion between the foot and the sides of the foot-shaped cavity 68' which is supporting the foot, which could otherwise be caused by periodic compression of the mid-sole in response to foot loading while walking.

Figure 9A:
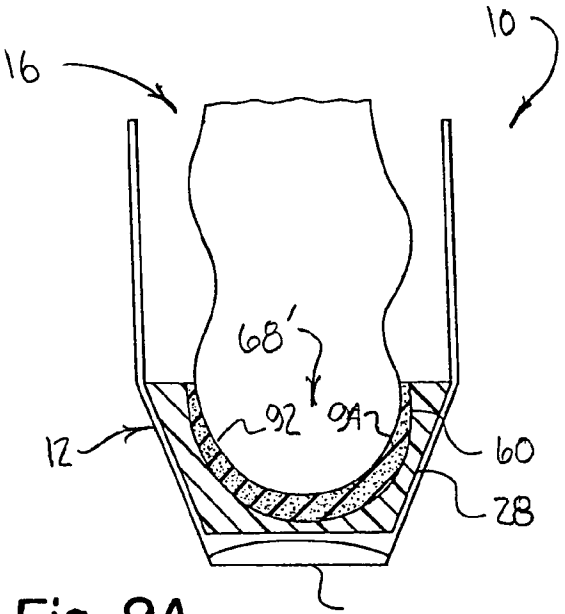
FIG. 9A illustrates a cross section elevation in the heel area of the improved walking boot of the present invention showing how part of the load is supported on the sides of the in-sole/mid-sole combination in addition to the support provided to the bottom of the foot.
Figure 8A:
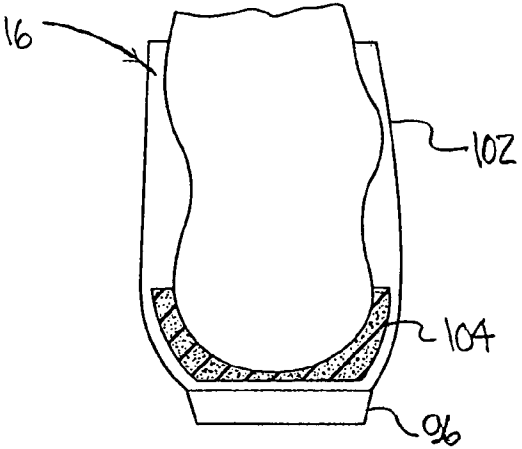
FIG. 8A is a cross sectional representation in elevation of the heel area of a patient standing in a total contact cast with the foam layer collapsed.

FIGS. 7A, 8A, 9A, and 16A schematically represent various supporting structures which might be considered as being in the nature of vertical cross sections through the heel portion of a supporting structure in FIGS. 8A and 9A. FIGS. 7B, 8B, 9B, and 16B are the respective schematic representations of the force distribution acting on the supported portion of the heel for the various support structure depicted in FIGS. 7A, 8A, 9A, and 16A. The magnitude of the force is indicated by the length of the arrows.

Figure 7A:
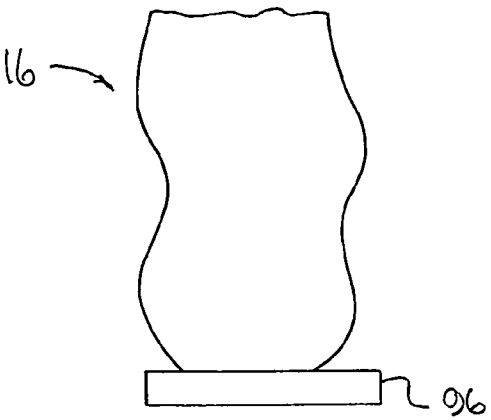
FIG. 7A is a representation in elevation showing the heel area of a patient's foot standing on a flat hard surface.
Figure 7B:
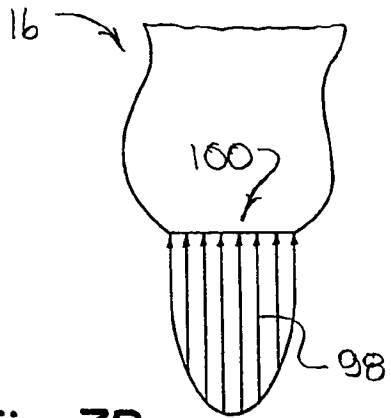
FIG. 7B is a schematic representation showing the parabolic nature of the high peak unit pressures generated by weight imposed upon the patient's heel to support the weight.

FIG. 7A illustrates the foot 16 supported on a board 96. This is a condition that would be experienced walking on a hard surface in bare feet. The heel bone is not far under the surface of the skin and fleshy padding. Although the fleshy padding is able to distribute the weight to some extent, the distribution of weight is limited and a fairly high pattern of peak forces 98 support the weight over a limited area. The forces vary, of course, from zero when the foot is in the air to a maximum when the heel comes down and the weight of the body is rolled over it. FIGS. 7B-9B and 16B are meant to indicate the maximum force distribution on the foot which occurs while walking or standing. In FIG. 7B, this maximum force is distributed over an area 100 which exhibits what we call a parabolic force distribution. The forces are highest in the center and drop off rapidly near the edges.

Figure 8B:
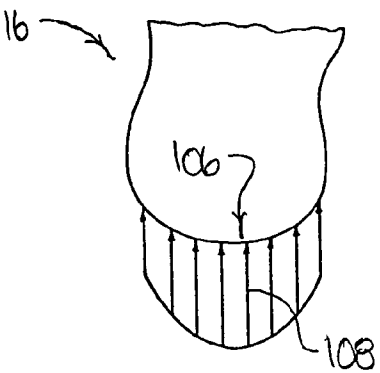
FIG. 8B is a schematic representation of the improved but still parabolic nature of the peak unit pressures produced in the heel area by the total contact cast in response to loading of the foot.

FIG. 8A schematically represents the Total Contact Cast 102. The cast material itself is material such as plaster of paris or a synthetic cross-linked polymer mixture. Not all of the layers of wrapping are shown here under the cast, but one possible feature that is shown is the elastomeric foam material 104. The board 96 is shown as it is usually a component of the Total Contact Cast. It can be seen that the supported area 106 is significantly larger than the area 100 of FIG. 7. The peak forces 108 are significantly smaller than are in FIG. 7B but they still have what we refer to as a parabolic shape with the highest forces applied to the lowermost boney parts of the foot. Most of the supporting force is in the center and falls off rapidly to each edge. The inner soles of ordinary shoes and even custom molded shoes for diabetics would fall somewhere between FIGS. 7A and 8A, with resulting peak forces being somewhere between 98 and 108 as depicted in FIGS. 7B and 8B.

Figure 9B:
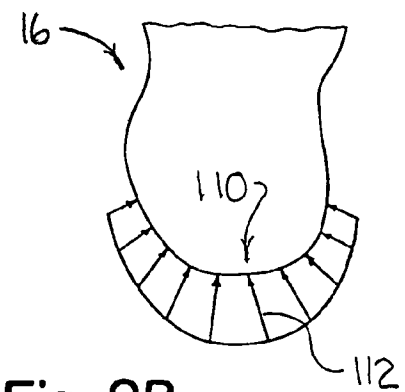
FIG. 9B is a schematic representation of the forces imposed on the patient's foot in support thereof by the improved walker boot of FIG. 9A wherein the load is supported over a greater area without parabolic peaks.

FIGS. 9A and 9B represent the improved walking boot 10 of the invention. FIG. 9A shows the unyielding walking shell 12 having a tread 22, closely supporting mid-sole 28 and preventing it from spreading outward. Inner-sole 60 has been substantially compressed by the weight of the foot to the point where it provides substantial resistance to further compression. Because the foot is "wedged" into the foot shaped cavity 68', the force to support the weight on the foot is distributed over a significantly larger area 110 and the resulting peak forces 112 in FIG. 9B are measurably less than FIG. 8B. Since the Total Contact Cast of FIG. 8A is the best known prior art structure, this means the improve walking boot of the invention represents an advance in the art of Orthopedic devices.

Figure 10:
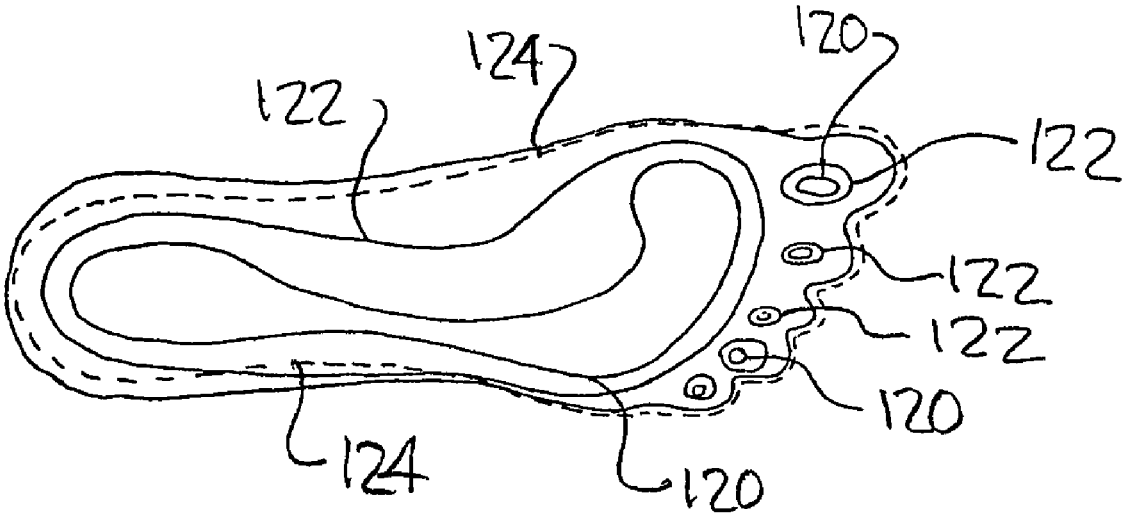
FIG. 10 is an outline of a person's foot indicating the amount of supported area when the foot is supported in different ways.
Figure 16B:
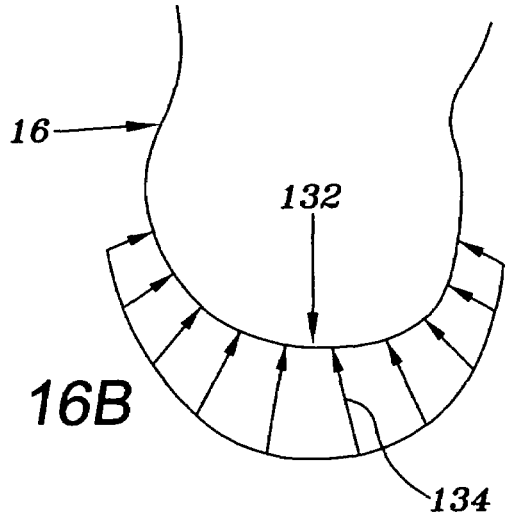
FIG. 16B is a schematic representation of the forces imposed on the patient's foot in support thereof by the improved walker boot of FIG. 16A wherein the load is supported over a greater area without parabolic peaks.

FIGS. 16A and 16B represent the second embodiment of the improved walking boot that uses a dual layer mid-sole 28. This walking boot has the same structure as shown in FIG. 9A, including the unyielding walking shell 12 having a tread 22, closely supporting mid-sole 28 and preventing it from spreading outward. Inner-sole 60 has been substantially compressed by the weight of the foot to the point where it provides substantial resistance to further compression. The only difference is that mid-sole 28 is further comprised of a higher density lower layer 126 and a lower density upper layer 128. Upper layer 128 of mid-sole 28 is more compressible than lower layer 126, providing mid-sole 28 an increased ability to accommodate the shape of foot 16 and any deformities thereon. Like the first embodiment of the improved walking boot, because the foot is "wedged" into the foot shaped cavity 68', the force to support the weight on the foot is distributed over a significantly larger area 132 and the resulting peak forces 134 in FIG. 16B are measurably less than FIG. 8B. Since the Total Contact Cast of FIG. 8A is the best known prior art structure, this means the improve walking boot of the invention represents an advance in the art of Orthopedic devices FIG. 10 is an orthotic of a person's foot indicating schematically the amount of supported area when the foot is supported in different ways. The area 120 might be the imprint of a damp bare foot on dry concrete. With a normal arch, the weight is distributed over a relatively small area compared to the area of the bottom of the boot. The area 122 is believed to be the kind of supported area that a contoured but generally flat and somewhat resilient walker orthotic insole might provide. There is more supported area to reduce unit pressure imposed on the bottom of the foot, but the supported area is still significantly less than the total available area. The dotted area 124 is meant to symbolize the amount of supported area that can be provided by the invention. Because part of the support for the foot comes from the peripheral areas of the foot, the foot load is spread over a still greater area with resulting lower unit pressure at any given location around or on the bottom of the foot.

A way has been found to measure plantar pressures under the foot using the Novel Pedar in-shoe pressure measurement system made by Novel of Dusseldorf, Germany. The Novel system has an insert which looks like the inner-sole in a shoe and is shaped like a foot so it will fit right into a shoe. The in-shoe sensor has an upper grid and a lower grid separated by a layer of silicone with a vinyl layer on the top and bottom of the in-shoe pressure measurement device. The grids form a plurality of little squares distributed regularly over the area of the in-shoe pressure measurement device. Conductors representing each of the little sensor squares are connected to a programmed computer which measures changes in capacitance that occur when the grids are moved closer to each other in response to pressure forces. The device is approximately 2 mm thick with approximately 99 sensors per insole and roughly 1 sensor per square centimeter depending upon the insole size. The Novel Pedar in-shoe pressure measurement device is calibrated by means of a diaphragm using a known air pressure to push down on the insole. Very low pressures below about 1 or 2 newtons per centimeter square are treated by the software as zero pressure.

Figure 11:
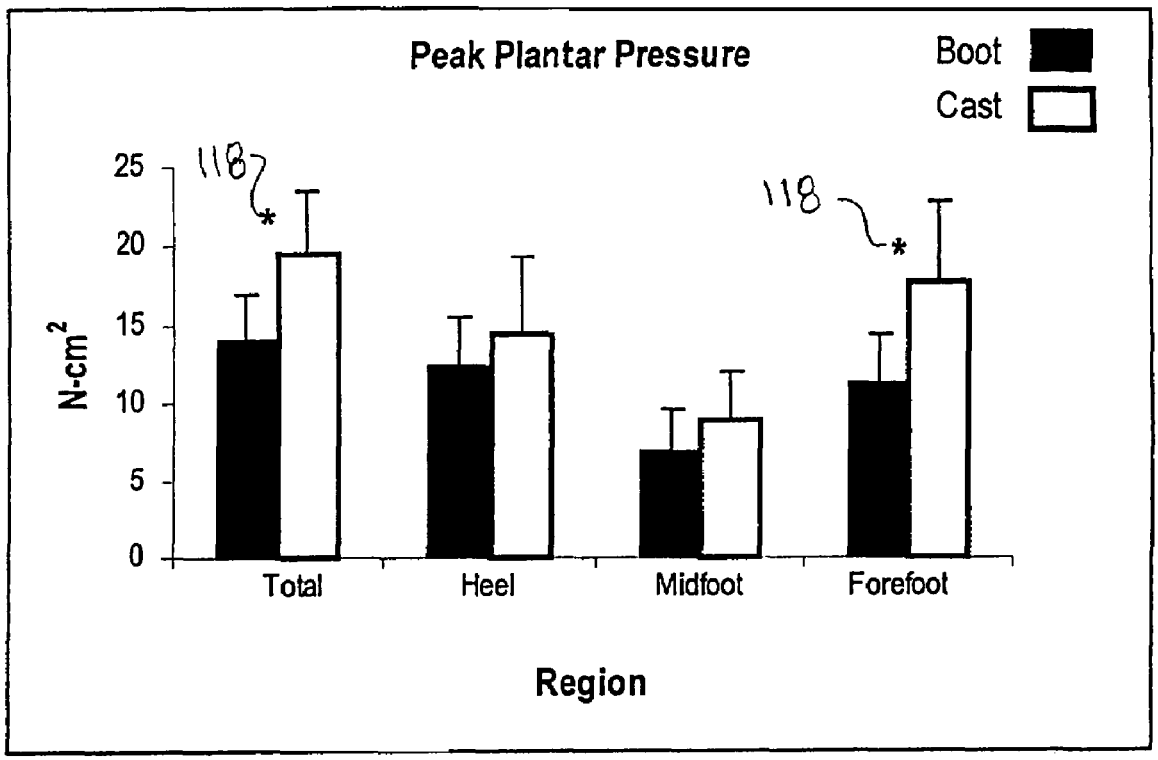
FIG. 11 is a graphical representation of the data from Table II showing that the average peak pressure on the plantar surface of the foot is lower with the present invention than the next best prior art alternative.

A series of comparisons were made using the Novel device to compare the performance of the best available orthopedic device, the Total Contact Cast, with the improved walking boot of the invention. Eighteen normal subjects without any prior foot or ankle problems were employed in this study. There were 7 females and 11 males in the study with an average weight of 85.6 kilograms and an average height of 177 centimeters. Data on these 18 subjects is given Table 1 below. The results of the tests are given in Table II and displayed graphically in FIG. 11.

TABLE 1

| SUBJECT | AGE | WEIGHT | HEIGHT |
|---|---|---|---|
| Sub 1 | 27.0 | 82.7 | 182.9 |
| Sub 2 | 46.0 | 86.4 | 182.9 |
| Sub 3 | 34.0 | 77.3 | 170.0 |
| Sub 4 | 27.0 | 62.7 | 154.0 |
| Sub 5 | 33.0 | 87.3 | 190.3 |
| Sub 6 | 49.0 | 75.0 | 177.8 |
| Sub 7 | 27.0 | 47.7 | 154.9 |
| Sub 8 | 45.0 | 115.9 | 193.0 |
| Sub 9 | 49.0 | 125.0 | 190.5 |
| Sub 10 | 39.0 | 100.0 | 188.0 |
| Sub 11 | 66.0 | 113.6 | 190.5 |
| Sub 12 | 38.0 | 117.3 | 162.6 |
| Sub 13 | 21.0 | 95.5 | 170.2 |
| Sub 14 | 34.0 | 66.4 | 177.8 |
| Sub 15 | 27.0 | 63.6 | 167.6 |
| Sub 16 | 35.0 | 86.4 | 188.0 |
| Sub 17 | 26.0 | 65.9 | 162.6 |
| Sub 18 | 46.0 | 72.7 | 172.7 |
| Average | 37.2 | 85.6 | 176.5 |
| Standard dev. | 11.3 | 21.9 | 12.7 |

The present invention has been given the name Bledsoe Conformer Diabetic Boot or "Boot". Each subject was asked to walk 1.) in the Bledsoe Conformer Diabetic Boot and 2.) in a well-padded Total Contact Cast which is also referred to as a short leg cast. The Total Contact Casts were all administered by the same casting technician using the same techniques applied by the Baylor University Medical Center, Dallas, Tex. to treat diabetic ulcers. The subjects were randomly assigned to the order of testing for the two conditions and asked to walk several times at a self-selected speed down a ten-meter walkway. Approximately 15 steps for each condition were used for averaging and statistical analysis. Paired t-tests were used to compare between the short leg cast results and the boot results at an alpha level of 0.05 for the statistical tests. The tests were naturally conducted over a period of weeks because it takes a great deal of time and effort to prepare and apply the Total Contact Cast to the individual feet. Pressure maps of each Novel insole were divided into three regions called masks: heel, midfoot, and forefoot. The heel is generally the area from the back of the heel to the front of the heel, the midfoot is generally the area from the front of the heel to the ball of the foot, and the forefoot is the area from the ball of the foot to the toes. Each mask area included a certain number of the sensor squares.

Although a number of different measurements were made, peak plantar pressure is considered to be most significant to the diabetic ulceration problem because of theories that below a certain peak plantar pressure new ulcers will not form and ulcers already formed will heal.

TABLE II

| | PEAK PRESSURE - N/cm$^2$ | | | | | | | |
|---|---|---|---|---|---|---|---|---|
| SUBJECT | BOOT TOTAL | CAST TOTAL | BOOT HEEL | CAST HEEL | BOOT MIDFOOT | CAST MIDFOOT | BOOT FOREFOOT | CAST FOREFOOT |
| Sub 1 | 15.2 | 23.3 | 14.3 | 16.0 | 8.1 | 7.9 | 13.6 | 23.0 |
| Sub 2 | 10.7 | 19.1 | 9.6 | 12.5 | 5.2 | 10.3 | 10.5 | 19.1 |
| Sub 3 | 14.3 | 22.3 | 12.9 | 14.5 | 5.3 | 8.7 | 14.3 | 22.3 |
| Sub 4 | 11.9 | 12.9 | 9.2 | 12.6 | 3.9 | 5.3 | 11.8 | 8.5 |
| Sub 5 | 14.2 | 21.7 | 12.9 | 16.6 | 5.6 | 11.6 | 13.3 | 21.6 |
| Sub 6 | 9.9 | 22.6 | 7.8 | 9.1 | 7.5 | 4.0 | 8.5 | 22.6 |
| Sub 7 | 13.7 | 14.5 | 12.6 | 11.8 | 7.2 | 8.0 | 12.8 | 14.2 |
| Sub 8 | 19.7 | 26.8 | 11.6 | 26.1 | 4.9 | 12.7 | 18.9 | 23.8 |
| Sub 9 | 13.2 | 21.0 | 9.5 | 17.0 | 3.2 | 10.5 | 13.2 | 20.8 |
| Sub 10 | 11.3 | 20.5 | 9.6 | 16.3 | 2.7 | 11.6 | 11.2 | 19.1 |
| Sub 11 | 20.5 | 24.1 | 20.5 | 16.3 | 9.7 | 16.3 | 11.6 | 23.8 |
| Sub 12 | 12.9 | 18.3 | 11.6 | 6.0 | 8.9 | 8.1 | 11.9 | 18.3 |
| Sub 13 | 13.7 | 20.3 | 13.7 | 10.2 | 8.6 | 9.8 | 9.7 | 20.3 |
| Sub 14 | 13.5 | 14.8 | 12.6 | 12.9 | 10.2 | 5.8 | 12.2 | 14.0 |
| Sub 15 | 13.8 | 20.2 | 12.8 | 20.2 | 3.7 | 6.5 | 9.8 | 9.6 |
| Sub 16 | 18.4 | 21.9 | 18.4 | 21.9 | 6.1 | 9.0 | 8.1 | 10.6 |
| Sub 17 | 14.5 | 15.6 | 13.2 | 12.9 | 13.2 | 9.6 | 9.3 | 15.2 |
| Sub 18 | 10.0 | 12.5 | 9.9 | 8.5 | 9.6 | 5.1 | 4.6 | 11.1 |
| average | 14.0 | 19.6 | 12.4 | 14.5 | 6.9 | 8.9 | 11.4 | 17.7 |
| stdev | 2.9 | 3.9 | 3.1 | 4.8 | 2.8 | 3.1 | 3.0 | 5.2 |
| T-test | | 0.00000 | | 0.07730 | | 0.05910 | | 0.00002 |

Table II has four columns containing comparative data for each subject wearing the boot and the cast. The data is paired and given in terms of newtons of force per centimeter squared. The left hand column gives the peak pressure in newtons per centimeter square that was found anywhere on the foot. The other three columns from left to right give the peak pressure respectively in the heel, midfoot and forefoot area for each of the Bledsoe Conformer Boot and the Total Contact Cast. Averages and standard deviations were calculated for each column of data. In each case the average peak pressure for the boot was lower than the average peak pressure for the Total Contact Cast in every area of the foot. The difference was considered to be statistically significant in at least the midfoot and forefoot areas in this test and in another test was considered to be statistically significant in each of the heel, midfoot and forefoot areas. The cross bar and stem sitting on top the vertical data bars in FIG. 11, as indicated by asterisks 118, are meant to represent the scope of the range of the data contained within the data bar. This is true for all data bars.

Figure 12:
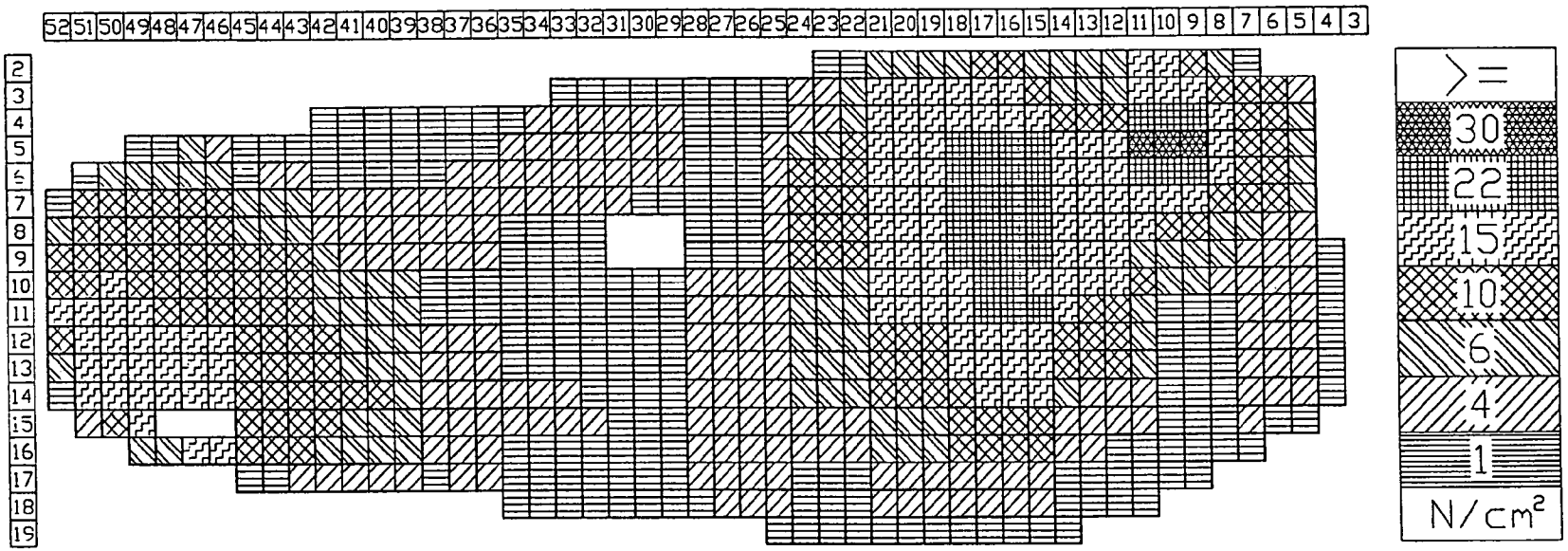
FIG. 12 shows a grid of average peak pressure measurements for a patient wearing an ordinary shoe.
Figure 13:
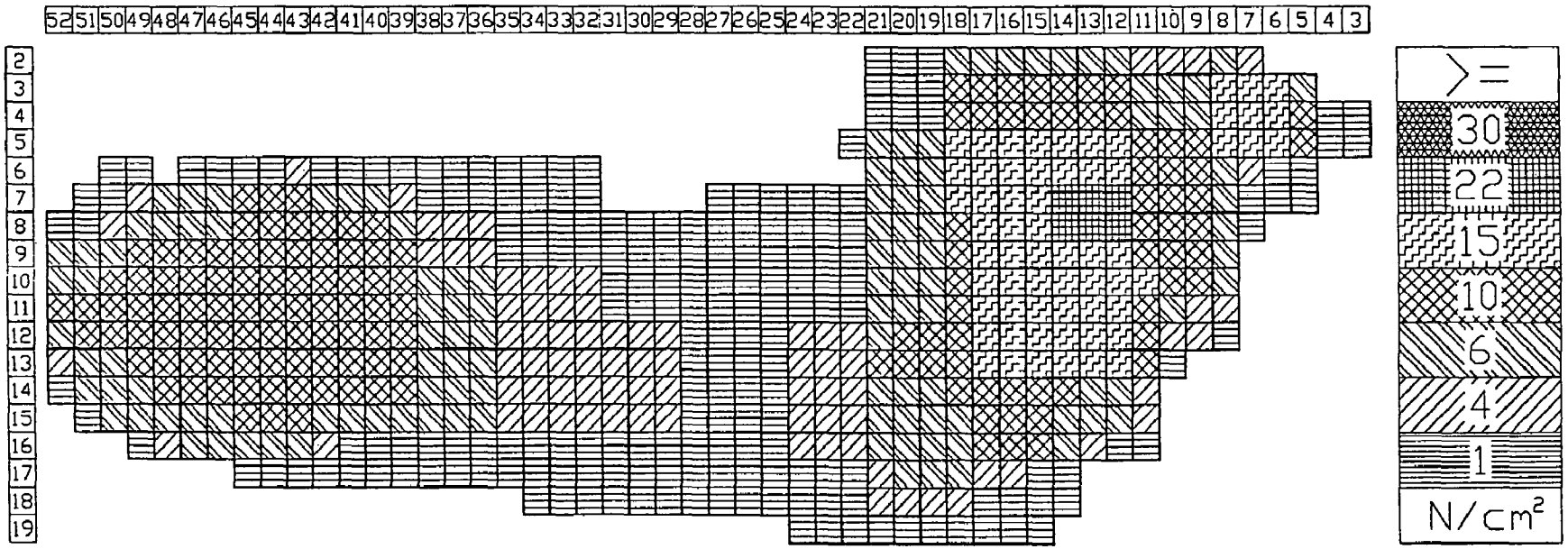
FIG. 13 is a grid of average peak pressure measurements for the same patient using the Total Contact Cast.
Figure 14:
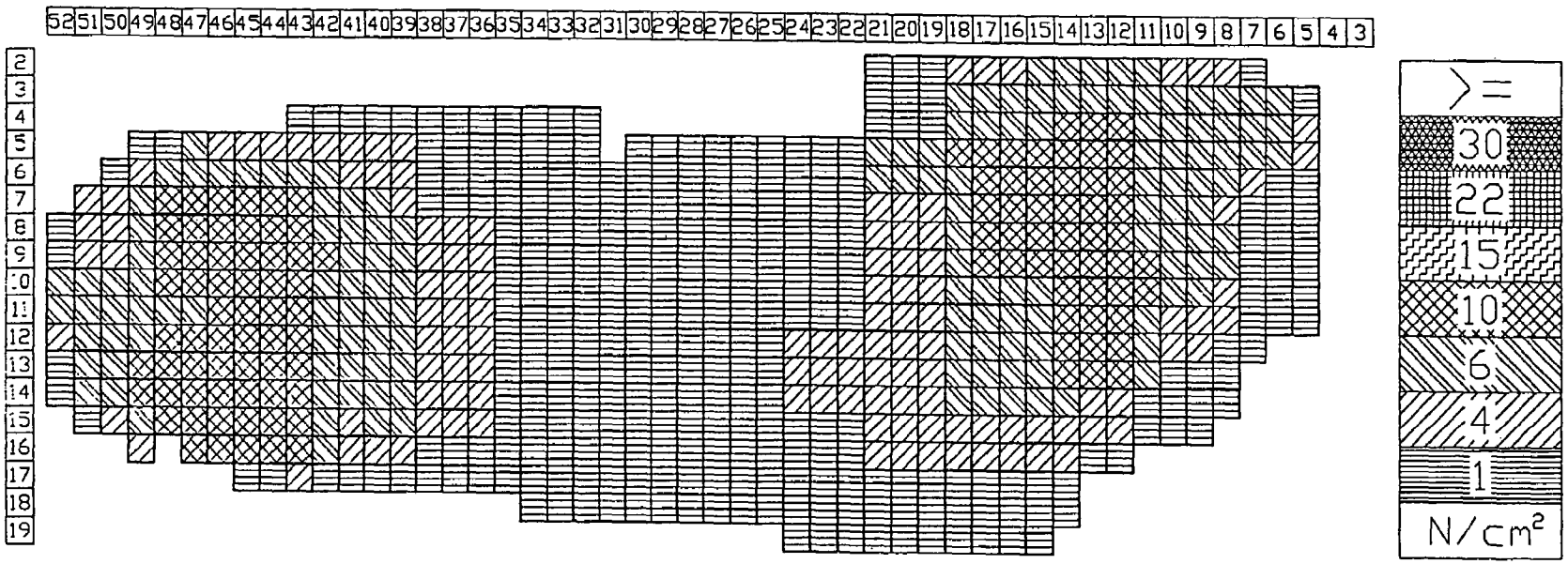
FIG. 14 is a grid of average peak pressure measurements for the same patient showing lower peak pressures with the improved walker boot of the invention.

FIGS. 12, 13 and 14 show representations of the sensor quadrants for a single patient wearing the shoe, the Total Contact Cast and the Bledsoe Conformer Boot. Each of the small squares can be considered a pressure sensor of the Novel Pedar in-sole sensing device. A grid of numbers at the left and above identify the sensor squares. A graphical code for the pressure reading is given on the right hand side of each chart in newtons per square centimeter. The values are indicated as being greater than or equal to the number corresponding to the graphical code. While the scale shown only goes up to 30 newtons per square centimeter, it should be understood that some of these values actually went up to a figure of 60 newtons per centimeter squared but this was not reflected in the charts. The heel in these charts is on the left hand side of the chart. A blank area in the shoe chart indicates a failure of the sensors to record a pressure value.

What is significant about these charts is that they illustrate the difficulty of the problem because of the varying contours of the plantar surface of the foot and the boney projections which distribute weight nonuniformly and in fact create "hot" spots. In the shoe example of FIG. 12 it can be seen that there is an area of high pressure in excess of 30 newtons per square centimeter which appears to be near the big toe area. There are pressures in excess of 22 newtons per square centimeter in the area of the ball of the foot. The Total Contact Cast of FIG. 13 exhibits lower pressures overall but there are still some areas in excess of 22 newtons per square centimeter. While pressure below about 50 newtons per square centimeter can prevent the formation of new ulcers, even lower pressures result in additional damage to the patient's skin, thereby preventing or at least retarding healing of the ulcer. It is currently believed that if the maximum unit pressure is dropped below 20 n/cm$^2$, very little additional damage is done and the healing process is maximized. As shown in the table, the Bledsoe Conformer Boot in this example had no areas anywhere on the foot that were equal to or greater than 15 newtons per centimeter squared.

In the best mode, the walker shell is formed from aluminum sheet because it is lightweight and will bend should it be necessary to make slight adjustments. The self-molding inner-sole is a closed cell off-white PVC foam from Saint-Gobain Performance Plastics Corporation, Granville, N.Y. under the designation HAFG 16 having an overall thickness of about ½ inch. The material has a density of about 7.5 pounds per cubic feet and a hardness on the Shore 00 scale which is said to be about 56. The material has the characteristic that it will readily compress to less than half its thickness and if compressed to less than half its thickness for a significant period of time by the foot, tends to retain the compressed shape. It has a fairly flat increase in deflection before it begins to resist.

The mid-sole is preferably made from Bayflex® 904 obtained from the polymer division of Bayer Corporation. It is described as a microcellular polyurethane foam system that was developed for use in applications requiring a microcellular core and a tough abrasion-resistant outer surface. It is formulated to a "hardness" of about 65-75 on the Shore 00 scale.

The dual layer mid-sole of the second preferred embodiment is made up of a higher density lower layer 126 that is preferably a polyurethane self-skinning foam with a hardness of about 25-30 on the Shore A hardness scale and a density of about 0.40. Lower density upper layer 128 of mid sole 28 is preferably a slow rebound recovery foam having a hardness of about 50-55 on the Shore 00 scale and a density of about 0.33. Higher density lower layer 126 is preferably about one-third the overall thickness of mid-sole 28 and lower density upper layer 128 is preferably about two-thirds the overall thickness of mid-sole 28.

As can be seen, mid-sole 28 and inner-sole 60 are made of materials that are significantly softer than the materials generally found in regular shoe insoles. Shoe insoles are generally measured using the Shore "A" hardness scale. In contrast, the lower density upper layer 128 of the mid-sole and inner-sole 60 of the current invention, as disclosed above, use the Shore "00" hardness scale. Even the higher density lower layer 126 is at the very bottom of the Shore A scale and could properly be measured on the Shore 00 scale as well. The Shore 00 scale was developed to measure ultra-soft, gel-like materials. Each Shore hardness scale measures from 0-100, however due to a loss of accuracy the next lower scale should be used for measurements that fall below 20 and the next higher scale should be used for measurements that fall above 90. For comparison purposes, a Shore "A" hardness of 60 equates roughly to a Shore "00" of 93 and a Shore "A" hardness of 20 equates roughly to a Shore "00" of 70. Consequently, the types of foam materials discussed above that are used in the current invention are substantially different that those used in prior art shoe inserts. If the above disclosed foams were used for sole inserts for shoes, they would compress down to virtually zero thickness over a relatively short period of time due to the relatively large forces that are applied to the forefoot and hindfoot during various phases of the gait.

The shape of foot shaped cavity 68 and the compressibility of inner-sole 60 and to a lesser extent upper layer 128 of mid-sole 28 also helps to limit the slip shear forces between the skin and walking boot. Once weight is applied to foot 16, the compression set inner-sole 60 creates a pocket in foot receiving upper surface 82 in which the foot rests. The shape of upper surface 82, due to the compression set nature of inner-sole 60, matches the shape of the bottom of foot 16 when it is fully and evenly loaded. In addition to assisting in spreading the load out across the entire bottom and edges of foot 16, the pocket shape of upper surfaces 82 also serves to limit lateral shear movement of the foot over the upper surface 82 of insole surface. By preventing lateral shearing forces, the boot further minimizes any chafing of the foot against inner-sole 60 of boot 10, which could prevent the healing of or even create new ulcers on the bottom of foot 16.

Being able to evenly spread out the force across the entire bottom of foot 16 when fully loaded provides an advantage over the prior art total contact cast. Total contact cast 102 is molded onto foot 16 when it is in an unloaded position. This is significant, because while total contact cast 102 may provide an exact match to unloaded foot 16 the shape of foot 16 changes significantly when loaded. This is because various portions of the bottom of foot 16 contain different amounts of flesh that will be compressed by different amounts when foot 16 is fully loaded. In general, there is less compressible flesh over the heel and ball of the foot than other areas of the foot. The difference in the amount of compression upon loading for various sections of the foot means that despite matching the contour of foot 16 when cast, the total contact cast does not match the contours of foot 16 when fully loaded. When loaded, the resistance provided by total contact cast 102 will merely compress certain areas of foot 16 while other areas the resistance causes pressure to be applied to foot 16. This results in unequal pressure being applied to the bottom of foot 16 and in the parabolic pressure curve shown in FIG. 8B.

On the other hand, boot 10 contains multiple layers that accommodate the amount of compression of various portions of foot 16. First, inner-sole 60 is self molding. This means that when foot 16 is placed on inner-sole 60 and weight is applied, inner-sole 60 molds itself to the shape of the bottom of foot 16. Since this is accomplished while foot 16 is under load, inner-sole 60 takes on the shape of foot 16 after all of the compressible flesh has already been compressed. Further, foot shaped cavity 68 in mid-sole 28 is shaped with sloping sides such that the edges of foot 16 are contacted before the bottom of foot 16. This serves to pre-load the edges of foot 16, where there is more compressible flesh than on the bottom of foot 16. Therefore, by pre-loading the portions of foot 16 that contain more compressible flesh and by having inner-sole 60 molded to the shape of the loaded foot 16 as opposed to unloaded foot 16, boot 10 can apply more even pressure across the entire bottom of foot 16 when it is in a loaded position. In addition, the upwardly curving side walls 74, 76 and 78 of foot shaped opening 68 allow boot 10 to further distribute some of the force to the sides of foot 16, further reducing the peak pressure on any portion of foot 16.

The above embodiments of the current invention provide a walking boot 10 that effectively spreads out the load across the entire bottom and a portion of the sides of foot 16. This minimizes the peak pressure across the entire foot 16. However, in some cases it is desirable to provide even lower peak pressures over a portion of foot 16 while accepting marginally higher pressures over another portion of foot 16. For example, over ninety percent of ulcers in diabetic patients occur in the forefoot. For these patients, it is especially desirable to keep the peak pressure at an absolute minimum for the forefoot. Because walking boot 10 of the current invention is so successful at maintaining an extremely low peak pressure over the entire bottom of foot 16, it is possible to shift the load slightly either to the forefoot or to the hind foot without running the risk of creating peak pressures that are high enough to cause another ulcer to form. By shifting the load slightly either forward or backward, it is possible to further minimize the peak pressure on the foot at the location of the ulcer.

While applying small amounts of pressure to the ulcer site will actually stimulate the healing process, it has been found that pressure well below the level that cause the formation of new ulcers can cause enough damage to significantly retard or even prevent healing of the ulcer. Reducing the peak pressure over the ulcer below a second and lower threshold will allow it to heal in the shortest amount of time because no additional damage is being caused at the ulcer site to slow down the healing process. For example, it is currently believed that peak pressures above 50 newtons per square centimeter will result in the creation of new ulcers. However, healing of existing ulcers can be maximized by reducing the peak pressure over the ulcer to below about 20 newtons per square centimeter. Because the maximum peak pressure at any point on the bottom of foot 16 is so low using walking boot 10 of the current invention, shifting the load slightly to one side of foot 16 will not raise the peak pressure to levels anywhere near those that might cause a new ulcer to form while simultaneously further lowering the peak pressure over the ulcer site to a level that will ensure healing at a maximum rate.

Shifting the load to the front or back of the foot can be accomplished by changing the angle between foot bed 26 of shell 12 and the patient's lower leg. Normally, as shown in FIG. 1, the lower leg is fixed in position between and aligned with upright struts 38 such that the downward force of the patient's weight is being applied perpendicular to foot bed 26 of shell 12. Because the ankle and foot is fixed and cannot flex as they would in a shoe, the downward force remain perpendicular to foot bed 26 of shell 12 through all phases of the walking gait. This keeps the downward force of the patient's weight relatively evenly distributed between the front and heel portions of foot 16.

By changing the effective angle between foot bed 26 of shell 12 and the patient's leg, thereby either dorsiflexing or plantarflexing the ankle, it is possible to shift the overall load slightly forward or backward by some extent. This shift can be accomplished in a number of ways. First it is possible to hinge upright struts 38 to brackets 36 of shell 12 so that they can be adjusted forward and backward and locked into a position that creates the desired angle between uprights 38 and foot bed 26 of shell 12. The patient's lower leg is then aligned between upright struts 38 and secured between them. By using adjustable joints that are graduated, this method can allow for precise, measurable, and repeatable adjustment of the angle between the lower leg and foot bed 26.

Figure 19:
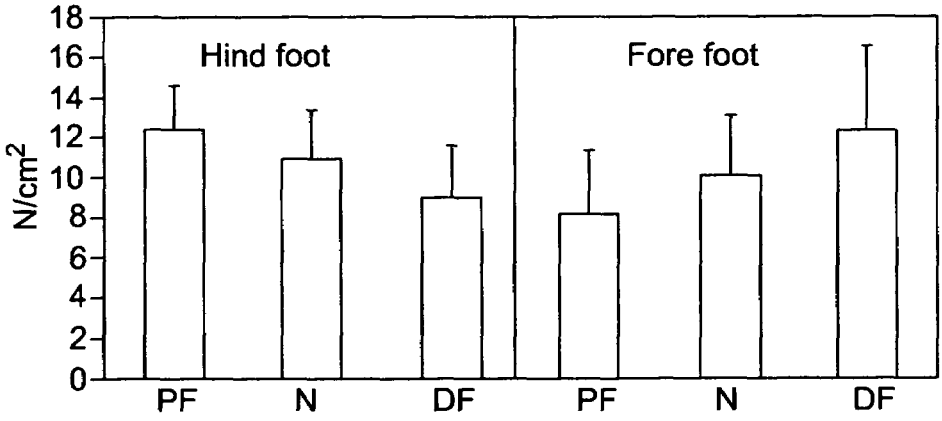
FIG. 19 is a graphical representation showing that the average peak pressure on the plantar surface of the hind foot and fore foot with the ankle in plantarflexion, neutral, and dorsiflexion positions.
Figure 17:
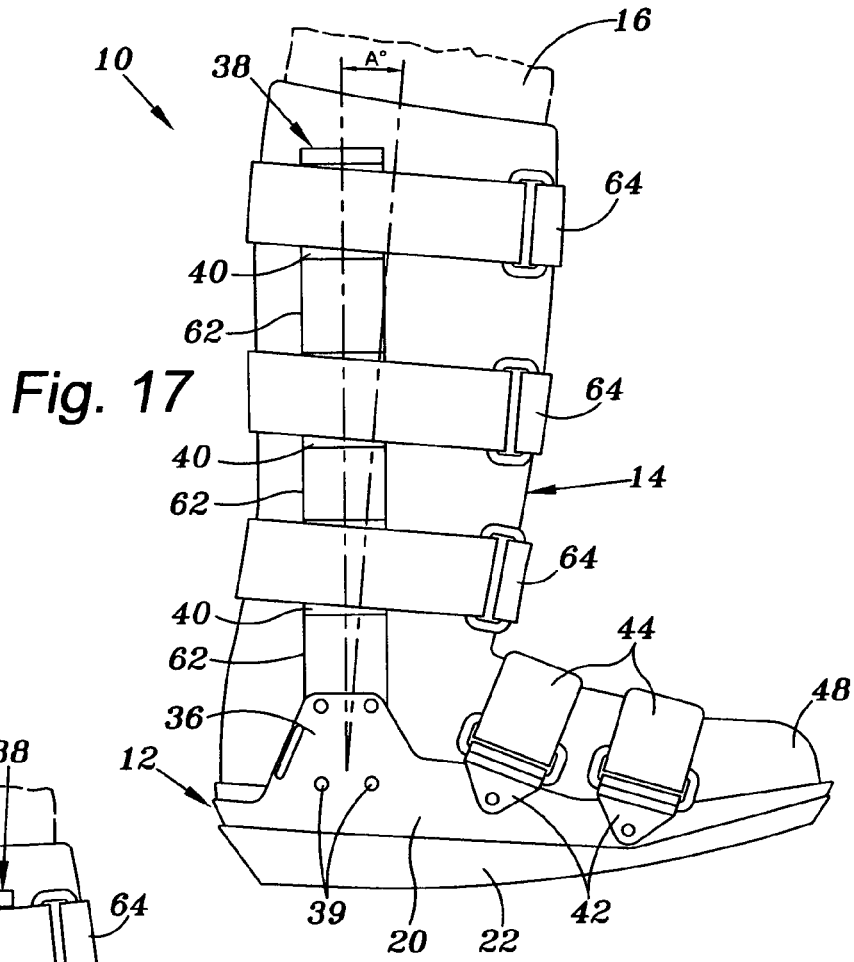
FIG. 17 is a side elevation view of the improved walker boot of FIG. 1 showing the leg secured between the upright struts with the ankle in A degrees of dorsiflexion.
Figure 18:
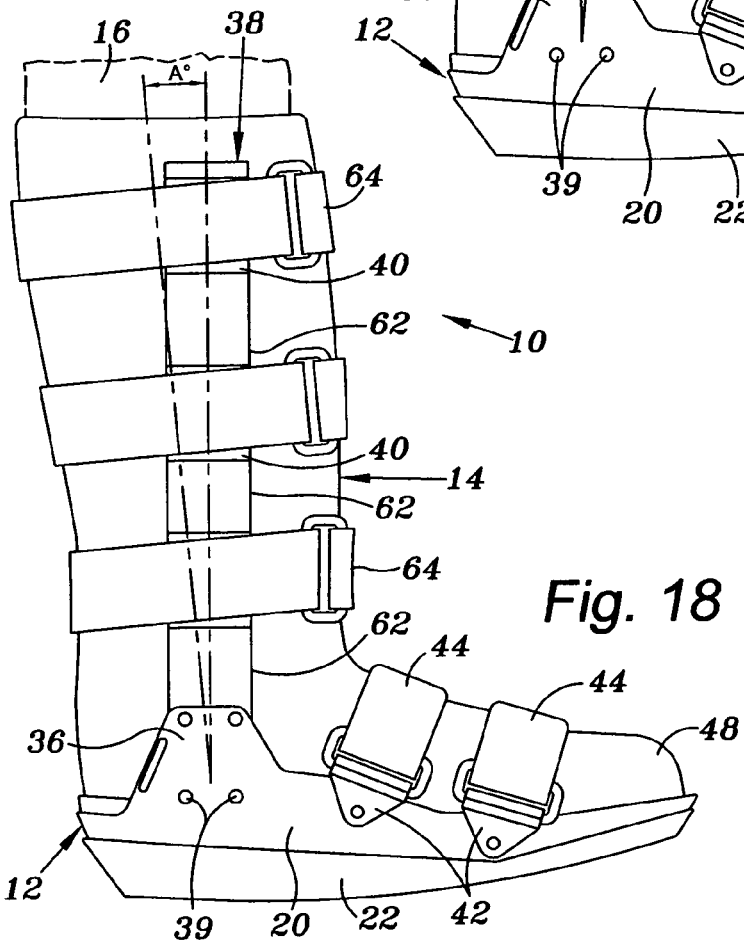
FIG. 18 is a side elevation view of the improved walker boot of FIG. 1 showing the leg secured between the upright struts with the ankle in A degrees of plantarflexion.

However, as shown in FIGS. 17 and 18, it has been determined that the addition of adjustable joints between bracket 36 and upright struts 38 are not needed and merely add unnecessary structure to walking boot 10. The same effect can be obtained by shifting the lower leg slightly forward or back by A degrees when securing it between upright struts 38. By moving the lower leg 16 forward or back relative to upright struts 38 before securing the lower leg between upright struts 38, the effective angle can be adjusted. When upright struts 38 are approximately 1½ inches wide, moving upright struts 38 one-half inch forward or back will result in angle A being approximately 5 degrees. Adjustable joints between uprights 38 and bracket 36 are not necessary because a 5 degree change in the angle between the lower leg and the foot bed is all that is necessary to partially shift the force toward the front or rear of foot 16. In order to further reduce pressure on the forefoot of foot 16, the upper end of uprights 38 should be moved forward relative to lower leg, which plantar flexes the ankle. As shown in FIG. 18, plantarflexion will shift the apparent weight bearing line posterior to reduce peak forefoot pressure while slightly increasing heel pressure on the bottom of foot. As shown in FIG. 17, to further reduce pressure on the heel of foot 16, the upper ends of uprights 38 should be moved backward relative to the lower leg, which dorsiflexes the ankle. Ankle dorsiflexion shifts the apparent weight bearing line anterior to reduce peak heel pressure while slightly increasing forefoot pressure on the bottom of foot 16. FIG. 19 is a graphical depiction of the peak pressure on both the hind foot and the fore foot in the current invention, when the ankle of foot 16 is in five degrees of plantarflexion (PF),a neutral position (N), or five degrees of dorsiflexion (DF). As can be seen by the graphical representation, slightly dorsiflexing or plantarflexing the ankle of foot 16 can reduce the peak pressure applied to the portion of foot 16 containing the ulcer to maximize healing, without increasing the peak pressure over the remainder of foot 16 to a level that could result in the creation of additional ulcers.

Although the invention has been disclosed above with regard to a particular and preferred embodiments, they are not intended to limit the scope of this invention. It will be appreciated that various modifications, alternatives, variation, etc., may be made without departing from the spirit and scope of the invention as defined in the appended claims.

What is claimed:

1. A method of supporting an injured foot, comprising:

providing a walking shell having inner and outer surfaces and one or more upright struts, wherein the outer surface is a walking surface and the inner surface is a foot bed designed to receive and support a mid-sole;

mounting a premolded mid-sole in the foot-bed, the mid-sole having a foot shaped cavity having a bottom surface with upwardly curving sides;

said mid-sole formed of a material having the characteristic of yielding without taking a compression set;

placing a self-molding inner-sole having a foot receiving upper surface and a bottom surface adapted to fit over the upper surface of the mid-sole in a manner that allows the inner-sole to conform itself closely to a foot and fit tightly against the upwardly curving walls of the mid-sole;

placing a foot on the foot receiving upper surface of the self-molding inner-sole over the foot receiving cavity in the mid-sole;

putting weight on the foot, thereby conforming and compressing the self-molding inner-sole closely against the loaded foot between the bottom and sides of the foot and the foot-shaped cavity;

said foot shaped cavity having a width and depth such that in response to foot pressure the peripheral edges of said foot are loaded by said upwardly curving sides of said foot shaped cavity prior to said bottom of said foot shaped cavity loading the bottom of said foot; and securing a lower leg to said one or more upright struts after said inner-sole is compression molded.

2. The method of claim 1 further comprising the step of protecting the foot from hard foreign particles by surrounding the lower leg and foot with a durable and resilient soft protective bootie, said bootie having an open bottom that is secured to a flange around said foot receiving upper surface on said inner-sole.

3. The method of claim 1 further comprising the step of securing the ankle in slight dorsiflexion thereby further reducing the peak pressure on the hind foot.

4. The method of claim 3 wherein said slight dorsiflexion is created by angling said lower leg forward slightly before securing said lower leg to said one or more upright struts.

5. The method of claim 3 wherein said slight dorsiflexion is created by adjusting the angle of said one or more upright struts and said walking shell to angle said upright strut backward prior to securing said lower leg in alignment with said one or more upright struts.

6. The method of claim 1 further comprising the step of securing the ankle in slight plantarflexion, thereby further reducing the peak pressure on the fore foot.

7. The method of claim 6 wherein said slight plantarflexion is created by angling said lower leg backward slightly before securing said lower leg to said one or more upright struts.

8. The method of claim 6 wherein said slight plantarflexion is created by adjusting the angle of said one or more upright struts and said walking shell to angle said upright strut forward prior to securing said lower leg in alignment with said one or more upright struts.

* * * * *